US006929212B2

(12) United States Patent
Madrzak et al.

(10) Patent No.: US 6,929,212 B2
(45) Date of Patent: Aug. 16, 2005

(54) METHOD OF TRANSFERRING A MOVING WEB TO A CORE AND APPARATUS FOR IMPLEMENTING THE METHOD

(75) Inventors: Zygmunt Madrzak, Heidenheim (DE); Matthias Wohlfahrt, Heidenheim (DE)

(73) Assignee: Voith Paper Patent GmbH., Heidenheim (DE)

( * ) Notice: Subject to any disclaimer, the term of this patent is extended or adjusted under 35 U.S.C. 154(b) by 0 days.

(21) Appl. No.: 10/849,479

(22) Filed: May 20, 2004

(65) Prior Publication Data

US 2004/0211859 A1 Oct. 28, 2004

Related U.S. Application Data

(63) Continuation of application No. PCT/EP02/14045, filed on Dec. 11, 2002.

(30) Foreign Application Priority Data

| | | |
|---|---|---|
| Dec. 12, 2001 | (DE) | 101 61 073 |
| Dec. 21, 2001 | (DE) | 101 63 554 |
| Jan. 15, 2002 | (DE) | 102 01 410 |
| Feb. 18, 2002 | (DE) | 102 06 575 |

(51) Int. Cl.[7] ..... B65H 19/26; B65H 19/28

(52) U.S. Cl. ..... 242/526.2; 242/526.3; 242/532.3

(58) Field of Search ..... 242/526.2, 526.3, 242/521, 532.3, 532

(56) References Cited

U.S. PATENT DOCUMENTS

| | | | | |
|---|---|---|---|---|
| 3,599,888 A | * | 8/1971 | Coudriet et al. | 242/526.2 |
| 4,444,362 A | | 4/1984 | Karr | |
| 4,445,646 A | | 5/1984 | Karr et al. | |
| 5,184,787 A | | 2/1993 | Holzingger et al. | |
| 5,249,758 A | | 10/1993 | Muller et al. | |
| 5,251,835 A | | 10/1993 | Kyytsönen | |
| 5,314,132 A | * | 5/1994 | Ando et al. | 242/526.3 |
| 5,453,141 A | * | 9/1995 | Rodriguez | 242/526.2 |
| 5,954,290 A | | 9/1999 | Rodriguez et al. | |
| 6,129,305 A | | 10/2000 | Möller et al. | |
| 6,547,178 B2 | * | 4/2003 | Rodriguuez | 242/526.2 |

FOREIGN PATENT DOCUMENTS

| | | |
|---|---|---|
| AT | 405642 | 10/1999 |
| DE | 1952205 | 5/1970 |

(Continued)

*Primary Examiner*—John M. Jillions
(74) *Attorney, Agent, or Firm*—Greenblum & Bernstein, P.L.C.

(57) ABSTRACT

Method of transferring a moving web a new core wherein the method includes introducing at least one initial cutting piece between the moving web and a winding roll in such a way that a region of the at least one initial cutting piece remains uncovered by the moving web, connecting the at least one initial cutting piece to the new core, the connecting utilizing at least a temporary connection and occurring in the region of the at least one initial cutting piece which remains uncovered by the moving web, and cutting the moving web to form a new web start at least one of before the nip and before the moving web is wound onto the new core, wherein the connecting connects a new web start to the new core and thereafter allows the moving web to be wound onto the new core. This Abstract is not intended to define the invention disclosed in the specification, nor intended to limit the scope of the invention in any way.

194 Claims, 11 Drawing Sheets

FOREIGN PATENT DOCUMENTS

| | | |
|---|---|---|
| DE | 2326854 | 12/1973 |
| DE | 3515519 | 10/1986 |
| DE | 3635197 | 2/1988 |
| DE | 4004655 | 8/1991 |
| DE | 4007329 | 9/1991 |
| DE | 4208746 | 5/1993 |
| DE | 19807897 | 8/1999 |
| DE | 19822052 | 11/1999 |
| EP | 0350133 | 1/1990 |
| EP | 0543788 | 5/1993 |
| EP | 0483092 | 1/1998 |
| EP | 0887295 | 12/1998 |
| EP | 0788991 | 9/2000 |
| EP | 1035055 | 9/2000 |
| EP | 0912435 | 3/2003 |
| EP | 0997417 | 10/2003 |
| WO | 86/06357 | 11/1986 |
| WO | 89/01454 | 2/1989 |
| WO | 97 /22543 | 6/1997 |
| WO | 97/48632 | 12/1997 |
| WO | 98/52858 | 11/1998 |

* cited by examiner

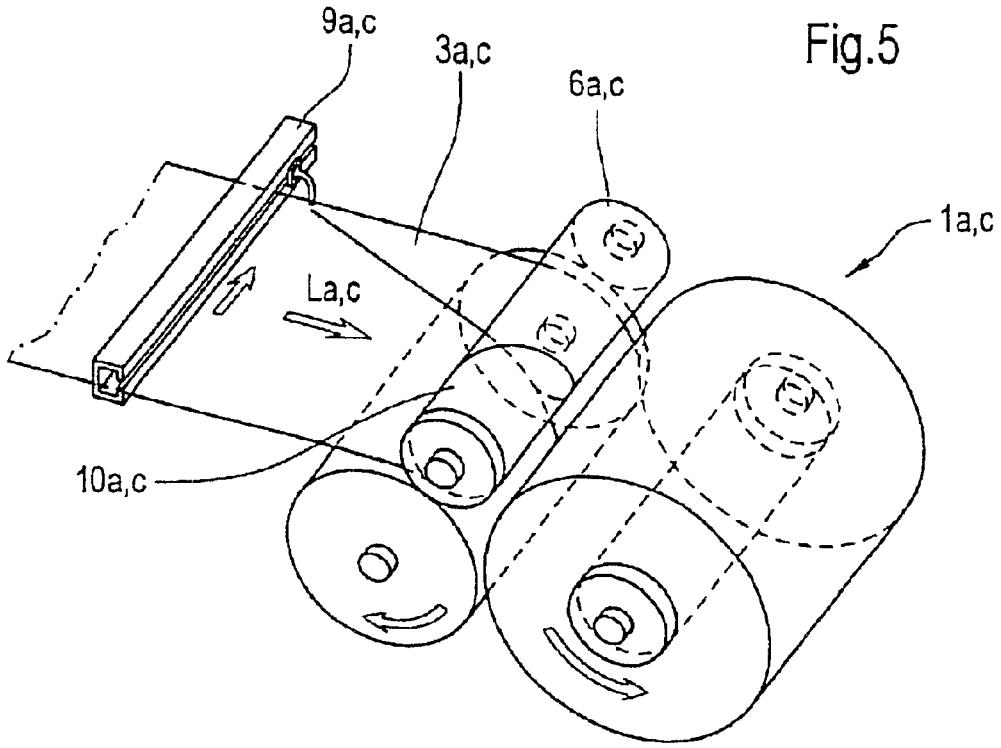
Fig.5
Fig.6
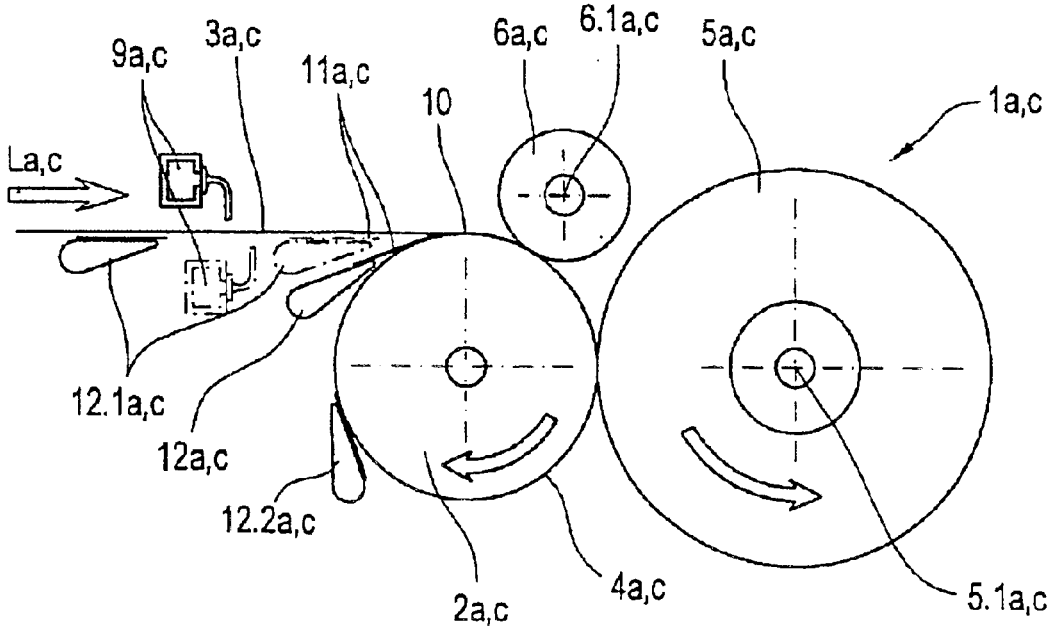

METHOD OF TRANSFERRING A MOVING WEB TO A CORE AND APPARATUS FOR IMPLEMENTING THE METHOD

CROSS-REFERENCE TO RELATED APPLICATIONS

The instant application is a continuation of International Application No. PCT/EP02/14045 filed on Dec. 11, 2002 and published as International Publication WO 03/050026 on Jun. 19, 2003, the disclosure of which is hereby expressly incorporated by reference hereto in its entirety. The instant application also claims priority under 35 U.S.C. §119 of German Application Nos. 101 61 073.4 filed on Dec. 12, 2001, 101 63 554.0 filed on Dec. 21, 2001, 102 01 410.8 filed on Jan. 15, 2002, and 102 06 575.6 filed on Feb. 18, 2002.

BACKGROUND OF THE INVENTION

1. Field of the Invention

The invention, according to a first and a second aspect, relates to a method of transferring a web, in particular a paper or board web, preferably running over a subregion of a winding roll, to a new core.

According to a third aspect, the invention relates to a method of transferring a web, preferably running over a subregion of a winding roll, in particular a paper or board web, to a new core forming a nip with the winding roll, in particular an empty spool. At least one transverse strip is preferably formed in at least one edge region of the web by way of at least one cutting device, preferably a transverse cutting device. This device may be arranged upstream of the nip in the running direction of the web. The invention additionally relates to an apparatus for implementing such a method with at least one cutting device, preferably a transverse cutting device.

The invention additionally relates to a respective winder for implementing such methods.

2. Description of the Prior Art

Such methods of transferring a web are applied, for example, in the region of a reel-up of a machine for producing paper or board, a coating machine, a slitter-rewinder or an equivalent machine, in order to wind up the web onto a plurality of empty cores one after the other, which are also referred to as empty spools. This occurs without interrupting the production process, that is to say without stopping the paper or board machine, or in order to wind up the web onto a preferably empty core sporadically, that is to say following a break in the paper or board web or after starting up the paper or board machine.

In the process, it must be ensured that the web start produced by cutting the web is supplied to the new core, in order to form a new wound reel on the latter.

German laid-open specification DE 42 08 746 A1 discloses a method of changing spools in which a web supplied continuously to a winding roll is transferred to a new spool (empty spool) which is in contact with the winding roll.

In this case, a central part of the web, what is known as a transfer strip, is cut by two cutting apparatuses at a point which is located above the winding roll in the running direction of the web. The transfer strip is provided with an adhesive medium on the top side, that is to say on the side facing the empty spool, by means of an adhesive supply apparatus and is stuck to the surface of the empty spool. The transfer operation is completed by the movement of the two cutting devices in the direction of the respective web edge.

In this method, it is therefore assumed that the adhesive medium has the capacity of tearing through the transfer strip completely and reliably at the latest as it leaves the nip.

Unfortunately, in practice this assumption is confirmed only in the rarest cases. This has also been recognized by the inventors of the aforementioned specification and, in order to divide the transfer strip (cutting the web between the cutting lines), a separate strip dividing device was proposed. Thus, in this embodiment, the method already disclosed by U.S. Pat. No. 4,445,646 A is used to its full extent, which has been expanded by the supply of adhesive medium to the top side of the transfer strip.

In this method, the outlay on construction and the exceedingly large number of components and subassemblies are disadvantageously required. In addition, chronological synchronization and reproducibility of the individual method steps constitute an uncertainty factor in the transfer of paper webs. Furthermore, the method is absolutely unsuitable for transferring paper webs with a high tearing strength, such as plastic webs and board.

The use of adhesives for the simultaneous cutting and transfer of the transfer strip to the empty spool is also in the foreground in the method disclosed by the published PCT specification WO 97/48632 A1. In addition to the already disclosed double-sided adhesive tape or label, the use of adhesives in the form of hot-melt and the like is also proposed here.

Furthermore, not only the application of the adhesives to the top side of the web but also the application of the adhesives to the circumferential surface of the empty spool is provided. This is a further possible way of supplying adhesive, but can have a decisive influence on increasing the reliability of the method.

On the other hand, one difference with respect to the German laid-open specification DE 42 08 746 (cited above) is to be found here in the arrangement and selection of the cutting apparatuses. Here, the use of mechanical circular knives which, in practice, are associated with many disadvantages, is dispensed with, and instead a water jet is provided as the cutting medium, with which the web can be cut both upstream of and directly on the winding roll.

The restriction to cutting the web with water jet at a point at which it is already guided over a part of the winding roll and supported is not absolutely necessary for process reasons. However, since a water-jet cutting apparatus upstream of the winding roll has already been disclosed by the German laid-open specification DE 42 08 746 A1 (cited above), in particular, as column 5, line 32, this restriction is nevertheless understandable. In addition, in this method the main disadvantage is to be seen in the fact that it is absolutely unsuitable for transferring paper webs with a high tearing strength.

Another idea with regard to the cutting of the transfer strip is disclosed in European patent application EP 0 543 788 A1. Although the separate strip dividing device is arranged downstream of the nip, as opposed to the two specifications already cited, DE 42 08 746 A1 and U.S. Pat. No. 4,445,646 A, it is not arranged on the top side of the web. The severing of the transverse strip, for example, by an air jet aimed at the web and empty spool, can then be configured relatively reliably in many webs. In order to implement this, however, the contact between the winding roll and the full roll must be canceled, at least briefly, which represents a critical disadvantage in a continuous winding process. In most cases, specific winding methods are required for this purpose which, amongst other things, include center drives and elements forming substitute nips. Methods and apparatuses of this kind are described, for example, in the two European patents EP 0 483 092 B1 and EP 0 788 991 B1, the PCT published specification WO 98/52858 A1, and the German laid-open specification DE 198 07 897 A1. However, these documents necessitate higher investment and operating costs. In addition, because of their operating mechanisms, they can lead to damage to the surface of the web.

A further disadvantage of these methods is represented by the rather random transfer of the web start to the empty spool. Although blowing on with an air jet is disclosed, in truth in this case trust is placed on what is known as self-threading of the web start onto the new core. In practice, this method can be used only conditionally: webs with a high grammage or stiffness, for example, such as board, cannot be transferred at all in this way. In addition, as a result of the lack of a connection between the web start and empty spool, no clean winding start can be ensured.

Furthermore, U.S. Pat. No. 5,954,290 A also discloses an apparatus for transferring a moving paper web to a new core. In this case, provision is made that, in an edge region of the paper web, a high-strength dividing tape, whose length is a multiple of the web width, can be introduced directly into the nip in such a way that its start is connected to the new core. After that, the dividing strip is wound spirally onto the new core, simultaneously tearing through the entire web and transferring it to the new core.

Although this method, which has been known for decades and is common, in particular, in the paper industry, has been improved continuously and developed further over the course of time, until now its principal disadvantage could not be eliminated. This consists in the fact that, after the spool change, the dividing tape remaining on the surface of the core, whose thickness cannot be arbitrarily small, for process reasons, always produces pressure points in the web which lead to the production of a considerable quantity of broke in the core area of the roll, which has a highly detrimental effect on the efficiency of the overall production process. A further system-induced disadvantage of this method is to be seen in the necessity for the dividing tape to have to be introduced directly into the nip, which means that the position of the nip virtually cannot be changed. Furthermore, the dividing tape used for tearing the web represents a great danger of injury and fatality, and not just potentially, to the operating personnel. In addition, the question of environmentally suitable disposal of the dividing tape, used as a disposable product, is increasingly gaining importance.

Still further methods and apparatuses for transferring a moving web are known from various other publications, but are all afflicted with more or less severe disadvantages.

For example, U.S. Pat. No. 4,444,362 A discloses a method in which, in principle, there is no transfer strip at all, since the web start is already formed completely upstream of the winding roll by means of the transverse cutting devices.

As a result of arranging the transverse cutting devices downstream of the nip, as compared with this, a far more reliable method is produced, which likewise dispenses with the formation of transfer strips. However, this method, disclosed by European patent application EP 0 997 417 A1, can be used only on a reel-up which is equipped with a center drive and elements forming a substitute nip.

Furthermore, German patent DE 35 15 519 C2 describes a method in which, although a transfer strip is formed, its connection to the preceding web is already completely broken upstream of the nip. However, in the same way as in U.S. Pat. No. 4,444,362 A, the question also arises here as to how the web start "not bonded to anything" can be transported to the nip and led reliably on to the new core.

SUMMARY OF THE INVENTION

Therefore, the present invention provides a method and a winder of the type mentioned at the beginning which permits optimum transfer of a moving web to a new core with high process reliability, process efficiency and beneficial investment, as well as process costs. The invention also entirely avoids the disadvantages of the known prior art. Furthermore, the method should be capable of being applied as far as possible to the same extent to all known types of reel-ups and a broad range of webs.

According to the first aspect of the invention, at least one initial cutting piece is introduced between the web and a winding roll in such a way that a region of the initial cutting piece introduced is not covered by the web, in that, after reaching a nip formed by the winding roll and the new core, the initial cutting piece is connected to the new core, at least temporarily, in the uncovered region, and in that, at the latest at the point at which the web runs off the new core, at least cutting of the web by the initial cutting piece is effected and/or made possible. As a result of this a new web start, which is bonded to the initial cutting piece and the new core, is formed.

As a result of the specific introduction of at least one initial cutting piece between the web and the winding roll, which piece, after reaching the nip, is connected to the new core in the region not covered by the web, and the defined cutting of the web by the initial cutting piece, forming a new web start bonded to the initial cutting piece and the new core, the known disadvantages of the prior art are entirely avoided.

In particular, as a result of the defined and safe formation of a new, connected web start, an absolutely clean winding start is ensured, which constitutes the most important precondition for an optimum winding structure and a low quantity of broke. At the same time, with the method comprising only a few method features, the highest reproducibility and therefore associated reliability when transferring moving webs is achieved with extremely beneficial investment and method costs.

In a particular refinement according to the invention of the method, provision is made for at least one initial cutting piece to be introduced at least into one edge region of the web. And for a region of the respectively introduced initial cutting piece not to be covered by the web, for the initial cutting piece, after reaching the nip, to be connected to the new core, at the latest at the point where the web runs off the new core, for the web to be substantially completely severed by the respective initial cutting piece, a new web start bonded to the initial cutting piece and the new core being formed by the initial cutting piece. The width of the web start transferred to the new core is preferably enlarged by way of the cutting device in such a way that the entire web is transferred to the new core.

By way of this refinement, a short time period for the transfer of the web is achieved, which reduces the quantity of broke which necessarily accumulates in the process. As a result of the symmetry provided at the winding start, a generally undesired conical winding structure is also avoided. Furthermore, there is the possibility here of configuring the formation of the two web starts in time in such a way that the second, new, connected web start is formed only if the web transfer by way of the formation of the first new web start has not been carried out successfully.

However, in a further embodiment of the invention, the at least one initial cutting piece according to the invention can also be introduced in any desired region of the web to be transferred to a new core. The introduction of the initial cutting piece is therefore not restricted to the at least one edge region. A further region can be located, for example, in the center of the web, it being necessary for the web preferably to be processed appropriately in advance.

According to the first aspect of the invention, a winder includes at least one dispensing device for introducing at least one initial cutting piece between the web and the winding roll is arranged in such a way that the initial cutting piece can be introduced substantially directly or indirectly between the web and the winding roll. In this case, the advantages already indicated for the method according to the invention are achieved.

In a particular refinement according to the invention of the winder, it is proposed that, in at least one edge region of the web, there be at least one dispensing device, by way of which at least one initial cutting piece can be introduced between the web and the winding roll, in that the initial cutting piece, after reaching the nip, can then be connected to the new winding core in its region not covered by the web, in that the material web can then be severed by the initial cutting piece, forming a new web start bonded to the initial cutting piece and the new core, and in that the width of the respective new web start be capable of being varied by way of the cutting device in such a way that the entire web can be transferred to the new core.

This variant is advantageous in particular in the case of relatively wide or thick webs, for example board webs. In this way, the tendency to form a conical roll, which is generally undesired, is minimized. On account of the fact that the respective cutting devices and dispensing devices can also be used independently of one another for transferring the web, this refinement of the winder provides system-induced redundancy and, resulting from this, optimum process safety.

The arrangement of the at least one dispensing device according to the invention for introducing at least one initial cutting piece between the web and the winding roll is, however, not just restricted to the at least one edge region of the web. In a further embodiment of the invention, the dispensing device can also be introduced in any desired region of the web to be transferred to a new core. The introduction of the initial cutting piece is therefore not just restricted to the at least one edge region. A further region can be located, for example, in the center of the web, it being necessary for the web preferably to be processed appropriately in advance.

According to the second aspect of invention, a method includes at least one opening, in particular a slit or an introduction area, is produced in the region of the web, preferably by way of a first cutting device, in that, in the region of the introduction area, at least one initial cutting piece is introduced between the web and a winding roll in such a way that a region of the initial cutting piece introduced is not covered by the web, in that, after reaching a nip formed by the winding roll and the new core, the initial cutting piece is connected to the new core, at least temporarily, in the uncovered region. Also, at the latest at the point at which the web runs off the new core, cutting of the web by the initial cutting piece is effected and/or made possible, as a result of which at least two new web starts bonded to the initial cutting piece and the new core are formed.

Both by methods of the production of at least one opening, in particular, a slit or an introduction area, in the region of the web, preferably by way of a first cutting device, and also by way of the specific introduction of at least one initial cutting piece between the web and winding roll, the piece, after reaching the nip, is connected to the new core in the region not covered by the web. With the defined cutting of the web by the initial cutting piece, forming at least two new web starts bonded to the initial cutting piece and the new core, the known disadvantages of the prior art are entirely avoided.

In particular, as a result of the defined and secure formation of at least two new, connected web starts, an absolutely clean winding start is ensured. This constitutes one of the most important preconditions for an optimum winding structure and a low quantity of broke. At the same time, with the method comprising only a few method stages, the highest reproducibility, and therefore associated reliability, when transferring moving webs to new cores is achieved with extremely beneficial investment and method costs.

In a first refinement of the method, provision is made for the introduction area in the region of the web to be produced preferably by way of a first cutting device by creating and/or producing at least one removal strip. Producing such an introduction area gives rise, amongst other things, to the technological advantage that the initial cutting piece can be transferred better and more safely to the new core, i.e., because of the greater area.

In further refinements of the invention, the introduction area can be produced in the center of the web and/or between the two edge regions. The at least one introduction area can also additionally or alternatively preferably be two introduction areas which are produced in the two edge regions of the web. The production of the at least one introduction area depends in principle on the respective application, but each individual configuration is associated with specific advantages, such as the avoidance of what is known as a "winding carrot."

Advantageously, the at least one removal strip, having a strip width in the range from between approximately 10 mm to approximately 250 mm, in particular from between approximately 25 mm to approximately 100 mm, is produced by way of a first cutting device, such as a cutting element tried and tested in practice, the strip width again depending on the respective application.

With regard both to the runability and the process safety of the method, it is beneficial if the removal strip is removed directly after its production and/or creation by way of at least one removal device having a vacuum of between approximately 0.01 bar to approximately 0.2 bar, preferably of between approximately 0.05 bar to approximately 0.1 bar. As a result, it can no longer have a detrimental effect on or even prevent the introduction of the initial cutting piece.

In a further embodiment of the invention, use is made of an initial cutting piece which, in the region not covered by the web, is provided with a connection system with which, at the latest when reaching the nip formed by the winding roll and the new core, an at least temporary, sufficiently strong connection between the initial cutting piece and the new core is produced by the initial cutting piece. Using these arrangements according to the invention, for example, an adhesive, vulcanization, touch-and-close, suction stud, form-fitting, frictional-fitting or welded connection or a magnetic or electrostatic connection to the new core is produced. The factor common to all these arrangements and/or systems is that they are distinguished by a good cost-benefit ratio and, furthermore, also exhibit above-average process safety.

Furthermore, use is made of an initial cutting piece which, in the region covered by the web, has at least one adhesive region in order to produce at least a temporary connection between the web or between the new web start and the initial cutting piece.

In order not to achieve any noticeable increase in diameter, use is preferably made of an initial cutting piece with a thickness in the range from between approximately 0.5 mm to approximately 0.05 mm, preferably in the range from between approximately 0.25 mm to approximately 0.1 mm. This thickness ensures that no markings in the web are produced on account of the initial cutting piece.

Furthermore, use is made of an initial cutting piece formed by molding which may be of, e.g., a plastic, a metal, a textile material, a tear-resistant fibrous material, in particular paper, a combination of materials, or at least one combination of one or more of these materials. This molding makes the handling of the initial cutting piece substantially easier but without having any detrimental influence on the transfer of the moving web to a new core.

In addition, the initial cutting piece can be formed as a preferably easily detachable part of a carrier.

Alternatively, before being introduced between the web and winding roll, the initial cutting piece can be fitted to at least one carrier by way of a relatively easily detachable connection. In this way, the at least one carrier, after leaving the nip, is ideally carried along neither with the new web start nor with the new core.

In order that two new web starts can preferably be formed in a defined manner, the initial cutting piece is provided with an arrangement for punching, cutting, perforating or embossing the web, with which, at the latest at the point where the web runs off the new core, the web is weakened or even severed in such a way.

In a further embodiment of the invention, the initial cutting piece is introduced substantially directly between the web and the winding roll by way of a dispensing device.

Here, in the case of a winding roll around which the web does not wrap, the initial cutting piece is introduced substantially directly into the nip by way of at least one dispensing device. It can also be introduced indirectly between the web and the winding roll by way of at least one dispensing device. It can also initially be applied to the underside of the web and is then introduced between the web and the winding roll by way of the web. Also, in the case of a temporary connection, it can be initially applied to the circumferential surface of the winding roll and then introduced between the web and the winding roll by way of the winding roll. In this way, a temporary connection is produced, e.g., by way of at least one adhesive area, by way of electrostatic forces, by way of magnetic forces, by way of applying vacuum to the winding roll, by way of a touch-and-close fastener, or by way of at least one suction stud coupling.

All these aforementioned introduction locations and possibilities have the aim of producing the most rapid and process-secure transfer of the moving web to a new core.

In an advantageous way, the width of the web starts transferred to the new core are enlarged by way of a second cutting device in such a way that the entire web is transferred to the new core. In this case, the second cutting device is moved relative to the web in a plane approximately parallel to the web, preferably at least substantially perpendicular to the running direction of the web, such that oblique cutting lines are produced. By way of these configurations, a shortened time period for the transfer of a moving web to a new core is achieved, as a result of which the quantity of broke which necessarily accumulates is reduced. By way of the symmetry provided at the winding start, a generally undesired conical winding structure is also avoided.

With regard to a rapid and process-secure transfer of the moving web to a new core, at the latest at the point at which the web runs off the new core, at least part of the web is substantially completely severed by the initial cutting piece. In this case, preferably at the latest at the point at which the web runs off the new core, at least part of the web is substantially completely severed along a cutting contour predefined by the initial cutting piece.

According to the second aspect of the invention, a winder is provided with a first cutting device for producing at least one opening, in particular a slit or an introduction area. This opening is arranged in the region of the web. At least one dispensing device is used for introducing at least one initial cutting piece between the web and the winding roll and is arranged in such a way that the initial cutting piece can be introduced substantially directly or indirectly between the web and the winding roll.

In this case, the advantages already indicated for the method according to the invention are achieved.

In further refinements of the invention, one or more dispensing devices are arranged in such a way that the initial cutting piece is initially applied to the underside of the web and can then be introduced between the web and the winding roll by way of the web. Additionally or alternatively, in the case of a temporary connection, the initial cutting piece is initially applied to the circumferential surface of the winding roll and can then be introduced between the web and the winding roll by way of the winding roll. These configurations permit adaptation of the winder to every conceivable application with higher process safety and a good cost-benefit ratio.

In an advantageous embodiment, the initial cutting piece has at least one adhesive region in the region covered by the web and also in the region not covered by the web. This provides the possibility of the initial cutting piece entering into an ideal connection both with the web and with the circumferential surface of the new core.

In the region covered by the web, the initial cutting piece has at least one cutting contour which is preferably formed neither in the running direction nor transversely with respect to the running direction of the web. This cutting contour benefits the actual cutting operation and thus increases the process safety for the transfer of the moving web to a new core.

Furthermore, the initial cutting piece ideally has a thickness in the range from between approximately 0.5 mm to approximately 0.05 mm, preferably in the range from between approximately 0.25 mm to approximately 0.1 mm, and may be formed by molding. The piece may also be made of, e.g., a plastic, a metal, a textile material, a tear-resistant fibrous material. In particular, the piece may be made of paper, or of at least one material combination. It may also be formed as a part of a carrier and/or, before being introduced between the web and the winding roll, may be applied to at least one carrier by way of a relatively easily detachable connection. These aforementioned possible properties of the initial cutting piece also benefit the actual cutting operation and thus increase the process safety for the transfer of the moving web to a new core.

According to the invention, the first and/or the second cutting device are arranged in the region of the winding roll and/or upstream of the winding roll in the running direction of the web, in the region of a free running path, and/or in the running direction of the web in a region in which the web touches at least one rolls mounted upstream of the winding roll.

Furthermore, the first and/or the second cutting device are arranged on the top side and/or the underside of the web and they are arranged in a common subassembly having preferably common components.

In addition, the refinements with regard to the arrangements of the first and the second cutting device permit adaptation of the winder to every conceivable application with high process safety and a good cost-benefit ratio.

With regard to short transfer times of the moving web to a new core, the second cutting device is arranged in the regions of the web which are not a constituent part of the web starts and are to be separated.

Generally, the cutting device provided is at least two preferably mutually independent cutting elements having a respective jet or beam with a high power density, in particular, a water-jet or laser-beam cutting element. Cutting elements of this type have already been tried and tested many times from many points of view in practice.

From process technological points of view, the initial cutting piece forms the last device and/or the last element—as viewed in the running direction of the web—for cutting and/or for transferring the web to the new core.

According to the third aspect of the invention, a method is provided wherein at least one initial cutting piece is introduced directly or indirectly between the at least one transfer strip and the winding roll by way of at least one dispensing device in such a way that a region of the initial cutting piece introduced is not covered by the transfer strip. The initial cutting piece, after reaching the nip formed by the winding roll and the new core, is connected to the new core, at least temporarily, in the uncovered region. At the latest at the point at which the web runs off the new core, at least cutting of the transfer strip by the initial cutting piece is effected and/or made possible. As a result, a new web start bonded to the initial cutting piece and the new core is formed.

As a result of the specific introduction of at least one initial cutting piece between the at least one transfer strip and the winding roll, which piece, after reaching the nip, is connected to the new core in the region not covered by the transfer strip of the web, and the defined cutting of the transfer strip by the initial cutting piece, forming a new web start bonded to the initial cutting piece and the new core, the known disadvantages of the prior art are entirely avoided.

In particular, as a result of the defined and safe formation of a new, connected web start, an absolutely clean winding start is ensured, which constitutes one of the most important precondition for an optimum winding structure and a low quantity of broke. At the same time, with the method comprising only a few method stages, the highest reproducibility, and therefore associated reliability, when transferring moving webs is achieved with extremely beneficial investment and method costs.

In a particular refinement according to the invention of the method, the invention provides that, in both edge regions of the web, in each case a transfer strip is formed by way of at least one cutting device, preferably a transverse cutting device, known from the prior art and arranged upstream of the nip in the running direction of the web, that, for each transfer strip, an initial cutting piece is introduced directly or indirectly between the transfer strip and the winding roll by way of a dispensing device in each case in such a way that a region of the initial cutting piece respectively introduced is not covered by the transfer strip. After reaching the nip, the initial cutting pieces are connected to the new core. At the latest, at the point at which the web runs off the new core, the transfer strips are substantially completely severed by the respective initial cutting pieces. As a result, for each initial cutting piece, a new web start bonded to the initial cutting piece and the new winding core is formed. The width of the web start respectively transferred to the new core is enlarged by way of the cutting device in such a way that the entire web is transferred to the new core.

By way of this refinement, a short time period for the transfer of the web is achieved, as a result of which the quantity of broke which necessarily accumulates in the process is reduced. As a result of the symmetry provided at the winding start, a generally undesired conical winding structure is also avoided. Furthermore, there is here the possibility of configuring the formation of the two web starts in time, for example, in such a way that the second, new, connected web start is only formed if the web transfer by way of the formation of the first new web start has not been carried out successfully.

According to the third aspect of the invention, at least one initial cutting piece can be introduced between the at least one transfer strip and the winding roll of a winder by way of at least one dispensing device. The respective initial cutting piece, after reaching the nip, can then be connected to the new core in its region not covered by the transfer strip. The respective transfer strip can be severed by the initial cutting piece, forming a new web start bonded to the initial cutting piece and the new core. In this way, the width of the at least one new web start can be varied by way of the cutting device in such a way that the entire web can be transferred to the new core.

In this case, the advantages already indicated for the method according to the invention are achieved.

In a particular refinement according to the invention, both edge regions of the web are provided with a transfer strip can be formed by way of at least one cutting device, preferably a transverse cutting device, arranged upstream of the nip in the running direction of the web. For both transfer strips, there is a dispensing device by way of which at least one initial cutting piece can be introduced between the respective transfer strip and the winding roll. The respective initial cutting piece, after reaching the nip, can then be connected to the new core in its region not covered by the transfer strip. The respective transfer strip can be severed by the initial cutting piece, forming a new web start bonded to the initial cutting piece and the new core. The width of the respective new web start can be varied by way of the cutting device in such a way that the entire web can be transferred to the new winding core.

This variant with two transfer strips is advantageous, in particular, in the case of relatively wide or thick webs, for example, board webs. In this way, the tendency to form a conical reel, which is generally undesired, is minimized. On account of the fact that the respective cutting devices and dispensing devices can also be used independently of one another for transferring the web, such a refinement of the winder provides for system-induced redundancy. This results in optimum process safety.

The invention also provides for a method of transferring a moving web a new core, wherein the method comprises introducing at least one initial cutting piece between the moving web and a winding roll in such a way that a region of the at least one initial cutting piece remains uncovered by the moving web, connecting the at least one initial cutting piece to the new core after the at least one initial cutting piece reaches a nip formed between the winding roll and the new core, the connecting utilizing at least a temporary connection and occurring in the region of the at least one initial cutting piece which remains uncovered by the moving web, and cutting the moving web to form a new web start at least one of before the nip and before the moving web is wound onto the new core. The connecting connects a new web start to the new core and thereafter allows the moving web to be wound onto the new core.

The at least one initial cutting piece may be connected to each of the new web start and the new core by one of bonding and adhesive bonding. The moving web may comprise one of a paper web, a plastic web, a board web and a cardboard web. The introducing may comprise introducing the at least one initial cutting piece at least in an edge region of the moving web. The at least one initial cutting piece may comprise, in a region which is not covered by the moving web, a connection arrangement adapted to connect the at least one initial cutting piece to the new core. The connection arrangement may comprise one of an adhesive connection arrangement, a vulcanization connection arrangement, a touch-and-close connection arrangement, a suction stud connection arrangement, a form-fitting connection arrangement, a frictional-fitting connection arrangement, a welded connection, a magnetic connection arrangement, and an electrostatic connection arrangement.

The at least one initial cutting piece may comprise a region which is covered by the moving web. The region which is covered by the moving web may comprise at least one adhesive region configured to produce at least a temporary connection between the new web start and the at least one initial cutting piece. The region which is covered by the moving web may comprise at least one adhesive region configured to produce at least a temporary connection between the moving web and the at least one initial cutting piece.

The at least one initial cutting piece may comprise a thickness which is in the range of between approximately 0.05 mm and approximately 0.5 mm. The thickness is in the range of between approximately 0.25 mm and approximately 0.1 mm.

The at least one initial cutting piece may comprise a molded member. The at least one initial cutting piece may comprise at least one of a plastic material, a metal material, a textile material, a tear-resistant fibrous material, a paper material, and a composite material.

The at least one initial cutting piece may be at least one of releasably connected to a carrier material and detachably connected to a carrier material.

Before the introducing, the method may comprise mounting with a detachable connection the at least one initial cutting piece on at least one carrier. The method may further comprise separating the at least one carrier from the at least one initial cutting piece.

Before the introducing, the method may comprise feeding the at least one initial cutting piece while being detachably mounted on at least one carrier. The method may further comprise separating the at least one carrier from the at least one initial cutting piece before the new web start is fully wound onto the new core.

The at least one initial cutting piece comprises a cutting arrangement. The cutting arrangement may comprise at least one of a punching device, a cutting device, a perforating device, and an embossing device. The cutting arrangement may be configured to at least one of weakened and severe the moving web so as to create the new web start. The cutting arrangement may be configured to at least one of weakened and severe the moving web so as to create the new web start having at least one edge which is not parallel relative to at least one outer edge of the moving web.

The introducing may comprise introducing the at least one initial cutting piece between the moving web and the winding roll. The introducing may comprise introducing the at least one initial cutting piece into the nip. The introducing may comprise introducing with at least one dispensing device the at least one initial cutting piece substantially directly between the moving web and the winding roll. The introducing may comprise introducing with at least one dispensing device the at least one initial cutting piece into the nip. The introducing may comprise introducing with at least one dispensing device the at least one initial cutting piece indirectly between the moving web and the winding roll. The introducing may comprise applying the at least one initial cutting piece to an underside of the moving web and allowing the moving web and the at least one initial cutting piece to pass through the nip. The introducing may comprise applying the at least one initial cutting piece to a circumferential surface of the winding roll and allowing the moving web and the at least one initial cutting piece to pass through the nip. The introducing may comprise applying the at least one initial cutting piece to an underside of the new web start and allowing the new web start and the at least one initial cutting piece to pass through the nip. The introducing may comprise applying the at least one initial cutting piece to a circumferential surface of the winding roll and allowing the new web start and the at least one initial cutting piece to pass through the nip. The applying may utilize a temporary connection which is produced by at least one of at least one adhesive area, electrostatic forces, magnetic forces, vacuum, a touch-and-close fastener, and at least one suction stud coupling.

The at least one initial cutting piece may be configured to at least one of cut and transfer the moving web to the new core. The at least one initial cutting piece may be configured to at least one of cut and transfer the new web start to the new core. The cutting may comprise enlarging a width of the new web start as it is wound onto the new core. The cutting may comprise enlarging with a cutting device a width of the new web start as it is wound onto the new core. The cutting may comprise enlarging with a movable cutting device a width of the new web start as it is wound onto the new core.

The invention also provides for a winder implementing any of the methods described above wherein the winder comprises at least one dispensing device configured to introduce the at least one initial cutting piece between the moving web and the winding roll, wherein the at least one dispensing device is arranged to introduce the at least one initial cutting piece substantially directly between the moving web and the winding roll.

The invention also provides for a winder implementing any of the methods described above wherein the winder comprises at least one dispensing device configured to introduce the at least one initial cutting piece between the moving web and the winding roll, wherein the at least one dispensing device is arranged to introduce the at least one initial cutting piece indirectly between the moving web and the winding roll.

The invention also provides for a winder implementing any of the methods described above wherein the winder comprises at least one dispensing device configured to introduce the at least one initial cutting piece between the moving web and the winding roll, wherein the at least one dispensing device is arranged to apply the at least one initial cutting piece to an underside of the moving web.

The invention also provides for a winder implementing any of the methods described above wherein the winder comprises at least one dispensing device configured to introduce the at least one initial cutting piece between the moving web and the winding roll, wherein the at least one dispensing device is arranged to apply the at least one initial cutting piece to a circumference of the winding roll.

The invention also provides for a winder arrangement which comprises a winding roll arranged to support a moving web, a new core forming a nip with the winding roll, and at least one dispensing device arranged in an area where the moving web meets the winding roll, the dispensing device being configured to introduce at least one initial cutting piece between the moving web and the winding roll, wherein the at least one initial cutting piece connects a new web start to the new core and thereafter allows the moving web to be wound onto the new core.

The at least one initial cutting piece may be configured to substantially completely sever at least a part of the moving web. The at least one initial cutting piece may be configured to substantially completely sever with at least one cutting contour at least a part of the moving web. The at least one initial cutting piece may comprise at least one adhesive region arranged in the region which is not covered by the moving web. The at least one initial cutting piece may comprise at least one adhesive region arranged in a region which is covered by the moving web.

The at least one initial cutting piece may comprise at least one cutting contour arranged in a region which is covered by the moving web. The at least one cutting contour may be oriented at an angle which is not parallel to either a web running direction or transverse to the web running direction. The at least one initial cutting piece may comprise a thickness in the range of between approximately 0.05 mm and approximately 0.5 mm. The thickness may be in the range of between approximately 0.25 mm and approximately 0.1 mm.

The at least one initial cutting piece may comprise a molded member. The at least one initial cutting piece may comprise at least one of a plastic material, a metal material, a textile material, a tear-resistant fibrous material, a paper material, and a composite material.

The at least one initial cutting piece may be at least one of releasably connected to a carrier material and detachably connected to a carrier material. The at least one initial cutting piece may comprise a cutting arrangement arranged upstream of the winding roll in a free running path region of the moving web. The cutting arrangement may comprise at least one of a punching device, a cutting device, a perforating device, and an embossing device. The cutting arrangement may be configured to at least one of weakened and severe the moving web so as to create the new web start. The cutting arrangement may be configured to at least one of weakened and severe the moving web so as to create the new web start having at least one edge which is not parallel relative to at least one outer edge of the moving web.

The at least one initial cutting piece may comprise a cutting arrangement arranged upstream of the winding roll in a region of another roll.

The winder may further comprise at least one cutting device arranged before the nip. The at least one cutting device may be arranged on a top side of the moving web. The at least one cutting device may be arranged on an underside of the moving web. The at least one cutting device may comprise at least one a cutting element. The at least one cutting element may comprise one of a high power density jet and a high power density beam. The at least one cutting element may comprise one of a water-jet and a laser-beam. The at least one cutting device may comprise a single cutting device arranged adjacent an edge of the moving web. The at least one cutting device may be configured to move completely transversely across the moving web. The at least one cutting device may comprise two cutting devices, each cutting device being arranged adjacent an edge of the moving web. Each cutting device may be adapted to move to as far as a center of the moving web.

The at least one initial cutting piece may comprise a device which cuts and transfers the new web start to the new core.

The invention also provides for a method of transferring a moving web to a new core, wherein the method comprises producing at least one opening in a region of the moving web, introducing, in a region of the at least one opening, at least one initial cutting piece between the moving web and a winding roll in such a way that a region of the at least one initial cutting piece remains uncovered by the moving web, connecting the at least one initial cutting piece to the new core after the at least one initial cutting piece reaches a nip formed between the winding roll and the new core, the connecting utilizing at least a temporary connection and occurring in the region of the at least one initial cutting piece which remains uncovered by the moving web, and cutting the moving web to form at least two new web starts at least one of before the nip and before the moving web is wound onto the new core, wherein the connecting connects the at least two new web starts to the new core and thereafter allows the moving web to be wound onto the new core.

The at least one initial cutting piece may be connected to each of the at least two new web starts and the new core by one of bonding and adhesive bonding. The moving web may comprise one of a paper web, a plastic web, a board web and a cardboard web. The introducing may comprise introducing the at least one initial cutting piece at least in an edge region of the moving web. The at least one initial cutting piece may comprise, in a region which is not covered by the moving web, a connection arrangement adapted to connect the at least one initial cutting piece to the new core. The connection arrangement may comprise one of an adhesive connection arrangement, a vulcanization connection arrangement, a touch-and-close connection arrangement, a suction stud connection arrangement, a form-fitting connection arrangement, a frictional-fitting connection arrangement, a welded connection, a magnetic connection arrangement, and an electrostatic connection arrangement.

The at least one opening may comprise one or a slit and an introduction area. The producing may comprise producing the at least one opening in a region of the moving web with a first cutting device. The producing may comprise forming with the first cutting device at least one removal strip. The producing may comprise producing at least one opening in a center region of the moving web. The producing may comprise producing at least one opening in a region of the moving web that is between two edge regions of the moving web. The producing may comprise producing at least one opening in each of two edge regions of the moving web. The producing may comprise producing the at least one opening in at least one of two edge regions of the moving web.

The method may further comprise forming with the at least one cutting device at least one removal strip having a strip width in the range of between approximately 10 mm and 250 mm. The strip width may be in the range of between approximately 25 mm and approximately 100 mm.

The method may further comprise forming with the at least one cutting device at least one removal strip and removing the at least one removal strip with at least one removal device. The at least one removal device may utilize a vacuum of between approximately 0.01 bar and approximately 0.2 bar. The vacuum may be between approximately 0.05 bar and approximately 0.1 bar.

The at least one initial cutting piece may comprise, in the region that is not covered by the web, at least one connecting strip non-removably attached to the at least one cutting piece. The at least one initial cutting piece may comprise a centrally disposed connecting strip non-removably attached to the at least one cutting piece and two angled connecting strips non-removably attached to the at least one cutting piece. The connecting strips may form a Y-shape. The at least one initial cutting piece may comprise at least one connecting strip non-removably attached to the at least one cutting piece.

The at least one connecting strip may comprise one of an adhesive connection strip, a vulcanization connection strip, a touch-and-close connection strip, a suction stud connection strip, a form-fitting connection strip, a frictional-fitting connection strip, a welded connection strip, a magnetic connection strip, and an electrostatic connection strip. The at least one initial cutting piece may comprise a region which is covered by the moving web. The region which is covered by the moving web may comprise at least one adhesive region configured to produce at least a temporary connection between the at least two new web starts and the at least one initial cutting piece. The region which is covered by the moving web may comprise at least one adhesive region configured to produce at least a temporary connection between the moving web and the at least one initial cutting piece.

The at least one initial cutting piece may comprise a thickness which is in the range of between approximately 0.05 mm and approximately 0.5 mm. The thickness may be in the range of between approximately 0.25 mm and approximately 0.1 mm. The at least one initial cutting piece may comprise a molded member. The at least one initial cutting piece may comprise at least one of a plastic material, a metal material, a textile material, a tear-resistant fibrous material, a paper material, and a composite material.

The at least one initial cutting piece may be at least one of releasably connected to a carrier material and detachably connected to a carrier material. Before the introducing, the method may comprise mounting with a detachable connection the at least one initial cutting piece on at least one carrier. The method may further comprise separating, before the nip, the at least one carrier from the at least one initial cutting piece.

The at least one initial cutting piece may comprise a cutting arrangement arranged upstream of the winding roll. The cutting arrangement may comprise at least one of a punching device, a cutting device, a perforating device, and an embossing device. The cutting arrangement may be configured to at least one of weakened and severe the moving web so as to create the new web start. The cutting arrangement may be configured to at least one of weakened and severe the moving web so as to create the new web start having at least one edge which is not parallel relative to at least one outer edge of the moving web.

The at least one initial cutting piece may comprise a cutting arrangement arranged upstream of the winding roll in a region of another roll.

The method may further comprise arranging at least one cutting device before the nip. The arranging may comprise arranging the at least one cutting device on a top side of the moving web. The arranging may comprise arranging the at least one cutting device on an underside of the moving web. The at least one cutting device may comprise at least one a cutting element. The at least one cutting element may comprise one of a high power density jet and a high power density beam. The at least one cutting element may comprise one of a water-jet and a laser-beam. The at least one cutting device may comprise a single cutting device arranged adjacent an edge of the moving web. The at least one cutting device may be configured to move completely transversely across the moving web. The at least one cutting device may comprise two cutting devices, each cutting device being arranged adjacent an edge of the moving web. Each cutting device may be adapted to move to as far as a center of the moving web.

The at least one initial cutting piece may comprise a device which cuts and transfers the new web start to the new core.

The introducing may comprise introducing the at least one initial cutting piece into the nip. The introducing may comprise introducing with at least one dispensing device the at least one initial cutting piece substantially directly between the moving web and the winding roll. The introducing may comprise introducing with at least one dispensing device the at least one initial cutting piece into the nip. The introducing may comprise introducing with at least one dispensing device the at least one initial cutting piece indirectly between the moving web and the winding roll. The introducing may comprise applying the at least one initial cutting piece to an underside of the moving web and allowing the moving web and the at least one initial cutting piece to pass through the nip. The introducing may comprise applying the at least one initial cutting piece to a circumferential surface of the winding roll and allowing the moving web and the at least one initial cutting piece to pass through the nip. The introducing may comprise applying the at least one initial cutting piece to an underside of the at least two new web starts and allowing the at least two new web starts and the at least one initial cutting piece to pass through the nip. The introducing may comprise applying the at least one initial cutting piece to a circumferential surface of the winding roll and allowing the at least two new web starts and the at least one initial cutting piece to pass through the nip. The applying may utilize a temporary connection which is produced by at least one of at least one adhesive area, electrostatic forces, magnetic forces, vacuum, a touch-and-close fastener, and at least one suction stud coupling.

The at least one initial cutting piece may be configured to at least one of cut and transfer the moving web to the new core. The at least one initial cutting piece may be configured to at least one of cut and transfer the new web start to the new core. The cutting may comprise enlarging a width of each new web start as it is wound onto the new core. The cutting may comprise enlarging with a cutting device a width of each new web start as it is wound onto the new core. The cutting may comprise enlarging with a movable cutting device a width of each new web start as it is wound onto the new core. The cutting may utilize first and second movable cutting devices. The cutting may utilize first and second cutting devices which move in a plane that is at least approximately parallel to the moving web. The cutting may comprise forming with at least one cutting device at least one oblique cutting line in the moving web. The cutting may comprise, before the nip, severing completely at least a portion of the moving web with at least one cutting device.

The invention also provides for a winder arrangement comprising a winding roll arranged to support a moving web, a new core forming a nip with the winding roll, at least one cutting device producing at least one opening in the moving web, and at least one dispensing device configured to introduce at least one initial cutting piece between the moving web and the winding roll, wherein the at least one initial cutting piece connects at least one new web start to the new core and thereafter allows the moving web to be wound onto the new core.

The at least one initial cutting piece may be configured to substantially completely sever at least a part of the moving web. The at least one initial cutting piece may be configured to substantially completely sever with at least one cutting contour at least a part of the moving web. The at least one initial cutting piece may comprise at least one adhesive region arranged in the region which is not covered by the moving web. The at least one initial cutting piece may comprise at least one adhesive region arranged in a region which is covered by the moving web. The at least one initial cutting piece may comprise at least one cutting contour arranged in a region which is covered by the moving web. The at least one cutting contour may be oriented at an angle which is not parallel to either a web running direction or transverse to the web running direction.

The at least one initial cutting piece may comprise a thickness in the range of between approximately 0.05 mm and approximately 0.5 mm. The thickness may be in the range of between approximately 0.25 mm and approximately 0.1 mm. The at least one initial cutting piece may comprise a molded member. The at least one initial cutting piece may comprise at least one of a plastic material, a metal material, a textile material, a tear-resistant fibrous material, a paper material, and a composite material. The at least one initial cutting piece may be at least one of releasably connected to a carrier material and detachably connected to a carrier material.

The at least one initial cutting piece may comprise a cutting arrangement arranged upstream of the winding roll in a free running path region of the moving web. The cutting arrangement may comprise at least one of a punching device, a cutting device, a perforating device, and an embossing device. The cutting arrangement may be configured to at least one of weakened and severe the moving web so as to create the new web start. The cutting arrangement may be configured to at least one of weakened and severe the moving web so as to create the new web start having at least one edge which is not parallel relative to at least one outer edge of the moving web. The at least one initial cutting piece may comprise a cutting arrangement arranged upstream of the winding roll in a region of another roll.

The at least one cutting device may be arranged before the nip. The at least one cutting device may be arranged on a top side of the moving web. The at least one cutting device may be arranged on an underside of the moving web. The at least one cutting device may comprise two cutting devices each having at least one a cutting element. Each at least one cutting element may comprise one of a high power density jet and a high power density beam. Each at least one cutting element may comprise one of a water-jet and a laser-beam.

The at least one cutting device may comprise two cutting devices arranged on a common device. The at least one cutting device may comprise two cutting devices, each configured to move transversely across the moving web. Each cutting device may be adapted to move to as far as a center of the moving web.

The invention also provides for a method of transferring a moving web to a new core, wherein the method comprises producing with at least one cutting device at least one transfer strip in an edge region of the moving web, introducing with at least one dispensing device at least one initial cutting piece between the at least one transfer strip and a winding roll in such a way that a region of the at least one initial cutting piece remains uncovered by the at least one transfer strip, connecting the at least one initial cutting piece to the new core, the connecting utilizing at least a temporary connection and occurring in the region of the at least one initial cutting piece which remains uncovered by the moving web, and cutting the at least one transfer strip with the at least one initial cutting piece, wherein the connecting connects at least one new web start to the new core and thereafter allows the moving web to be wound onto the new core.)

The connecting may comprise connecting the at least one initial cutting piece to the new core after the at least one initial cutting piece reaches a nip formed between the winding roll and the new core.

The at least one initial cutting piece may be connected to the at one new web start and the new core by one of bonding and adhesive bonding. The moving web may comprise one of a paper web, a plastic web, a board web and a cardboard web. The introducing may comprise introducing the at least one initial cutting piece each of two edge regions of the moving web. The at least one initial cutting piece may comprise, in a region which is not covered by the at least one transfer strip, a connection arrangement adapted to connect the at least one initial cutting piece to the new core. The connection arrangement may comprise one of an adhesive connection arrangement, a vulcanization connection arrangement, a touch-and-close connection arrangement, a suction stud connection arrangement, a form-fitting connection arrangement, a frictional-fitting connection arrangement, a welded connection, a magnetic connection arrangement, and an electrostatic connection arrangement. The at least one initial cutting piece may comprise, in the region that is not covered by the web, at least one connecting strip non-removably attached to the at least one cutting piece.

The at least one initial cutting piece may comprise at least one connecting strip non-removably attached to the at least one cutting piece. The at least one connecting strip may comprise one of an adhesive connection strip, a vulcanization connection strip, a touch-and-close connection strip, a suction stud connection strip, a form-fitting connection strip, a frictional-fitting connection strip, a welded connection strip, a magnetic connection strip, and an electrostatic connection strip.

The at least one initial cutting piece may comprise a region which is covered by the at least one transfer strip. The region which is covered by the at least one transfer strip may comprise at least one adhesive region configured to produce at least a temporary connection between the at least one new web start and the at least one initial cutting piece. The region which is covered by the at least one transfer strip may comprise at least one adhesive region configured to produce at least a temporary connection between the at least one transfer strip and the at least one initial cutting piece.

The at least one initial cutting piece may comprise a thickness which is in the range of between approximately 0.05 mm and approximately 0.5 mm. The thickness may be in the range of between approximately 0.25 mm and approximately 0.1 mm. The at least one initial cutting piece may comprise a molded member that comprises at least one of a plastic material, a metal material, a textile material, a tear-resistant fibrous material, a paper material, and a composite material. The at least one initial cutting piece may be at least one of releasably connected to a carrier material and detachably connected to a carrier material.

Before the introducing, the method may comprise mounting with a detachable connection the at least one initial cutting piece on at least one carrier. The method may further comprise separating, before the nip, the at least one carrier from the at least one initial cutting piece.

The at least one initial cutting piece may comprise a cutting arrangement. The cutting arrangement may comprise at least one of a punching device, a cutting device, a perforating device, and an embossing device. The cutting arrangement may be configured to at least one of weakened and severe the moving web so as to create the new web start. The cutting arrangement may be configured to at least one of weakened and severe the moving web so as to create the new web start having at least one edge which is not parallel relative to at least one outer edge of the moving web.

The method may further comprise arranging the at least one cutting device before the nip. The arranging may comprise arranging the at least one cutting device on a top side of the moving web. The arranging may comprise arranging the at least one cutting device on an underside of the moving web.

The introducing may comprise introducing the at least one initial cutting piece substantially directly between the at least one transfer strip and the winding roll. The introducing may comprise introducing the at least one initial cutting piece into the nip. The introducing may comprise introducing the at least one initial cutting piece indirectly between the at least one transfer strip and the winding roll. The introducing may comprise applying the at least one initial cutting piece to an underside of the at least one transfer strip and allowing the at least one transfer strip and the at least one initial cutting piece to pass through the nip. The introducing may comprise applying the at least one initial cutting piece to a circumferential surface of the winding roll and allowing the at least one transfer strip and the at least one initial cutting piece to pass through the nip. The introducing may comprise applying the at least one initial cutting piece to an underside of the at least one new web start and allowing the at least one new web start and the at least one initial cutting piece to pass through the nip. The applying may utilize a temporary connection which is produced by at least one of at least one adhesive area, electrostatic forces, magnetic forces, vacuum, a touch-and-close fastener, and at least one suction stud coupling.

The at least one initial cutting piece may be configured to sever substantially completely the at least one transfer strip. The at least one initial cutting piece may comprise a cutting contour configured to sever substantially completely the at least one transfer strip along the cutting contour. The cutting may comprise enlarging a width of the at least one new web start as it is wound onto the new core.

It goes without saying that the features of the invention mentioned above, and also to be explained below, can be used not only in the respectively specified combination but also in other combinations or on their own without departing from the scope of the invention. Here, in particular, any desired combination of the various aspects of the invention are also possible.

Further features and advantages of the invention emerge from the claims and the following description of preferred exemplary embodiments with reference to the drawings. Exemplary embodiments of the first and third aspects of the invention are described in particular with regard to FIGS. 2 to 14. A further exemplary embodiment of the first aspect of the invention is described with regard to FIG. 15. Particular exemplary embodiments of the second aspect of the invention are described by using FIGS. 16 to 23.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein;

FIGS. 2 to 5 show schematic and perspective illustrations of a winder according to a first embodiment according to the invention;

FIG. 6 shows an embodiment according to the invention of the winder in a schematic side view;

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Some of the terms used in the following description are defined as follows: A cutting device is a device which has at least one cutting element with which at least cutting or weakening of a web can be achieved. A transverse cutting device is a device which has at least one cutting element with which at least cutting or weakening of the web can be achieved, the position of which can be varied, as viewed transversely in the running direction of a web. A nip is a region of a winding roll with which the latter can exert an influence on a wound reel or a new core. A nip between the winding roll and the new core is also provided in the sense of this invention when these form a gap suitable for producing a connection between an initial cutting piece and the new core. An initial revolution is the first complete revolution of a new core after a connection has been made between the initial cutting piece and a new core.

Figure 1:
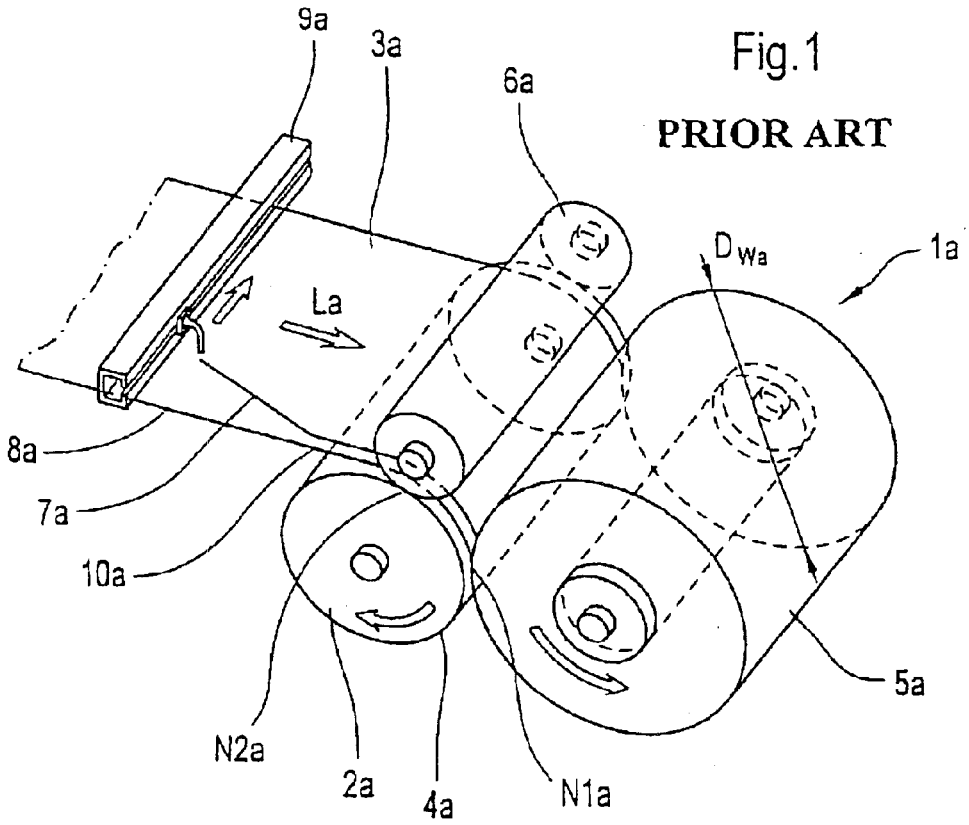
Fig.1 PRIOR ART
FIG. 1 shows a schematic and perspectively illustrated winder according to the prior art.

FIG. 1 shows a schematic and perspectively illustrated winder 1*a* according to the prior art. A winder of this type sufficiently well known, for example, from the PCT published specification WO 98/52858 A1 (and also EP 0 912 435 A1; U.S. Pat. No. 6,129,305 A) or the documents discussed above, i.e., EP 0 543 788 A1, DE 35 15 519 C2 or U.S. Pat. No. 4,445,646 A. Accordingly, the disclosure of each of these documents is hereby expressly incorporated by reference in their entireties.

The winder 1*a* comprises, inter alia, a winding roll 2*a* also designated a pressure drum or carrier drum. The web 3*a* is led out of a calender (not shown) to the winder 1*a*. The web 3*a* may also be led from a final group of a finishing machine or a drying section (also not shown) of a paper or board machine. Then it normally wraps around a guide or spreader roll (likewise not illustrated), and then it runs in the direction of the arrow La onto the circumferential surface 4*a* of the winding roll 2*a*. Thereafter, it wraps around the circumferential surface 4*a* of the winding roll 2*a* by a certain angle ("wrap angle") as far as the nip N1*a*, which is present between the winding roll 2*a* and the wound reel 5*a*. Finally, the web 3*a* is wound onto the wound reel 5*a*. If, then, the wound reel 5*a* has reached a predetermined diameter $D_{Wa}$, a new core 6*a* (empty spool) is accelerated forward by way of a drive device (not shown), and brought into contact with the winding roll 2*a*. This contact forms a nip N2*a*. Then, upstream of or on the winding roll 2*a*, at least one cut 7*a* is normally made in the moving web 3*a* in at least one edge region 8*a* by way of at least one known cutting device 9*a*. As a result, at least one transfer strip 10*a* is formed. In order to transfer the entire web 3*a* to the new core 6*a*, the transfer strip 10*a* is severed and transferred to the new core 6*a*.

Many variants of such a method of transferring a moving web, forming at least one transfer strip, are known, inter alia, from the documents mentioned above. However, none of these variants provide for the introduction of at least one element on the side of the web facing the winding roll in order to cut the transfer strip and in order to lead the transfer strip onto the new core.

FIGS. 2 to 5 show schematic and perspective illustrations of a winder 1*a,c* according to a first embodiment of the invention. The construction and control technology corresponding in principle to that of the winder 1*a* of FIG. 1 can be seen with reference being made to FIG. 1.

Figure 2:
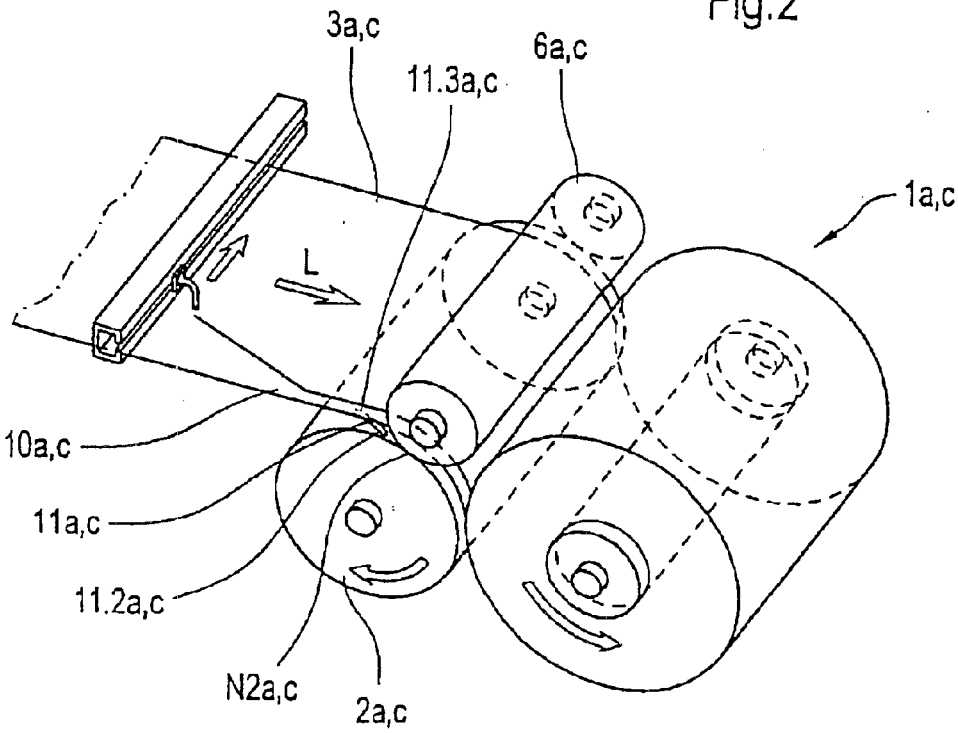

According to the invention, provision is made that, as illustrated in FIG. 2, at least one initial cutting piece 11*a,c* is introduced between the web 3*a,c* (which is preferably in the form of a transfer strip 10*a,c*) and the winding roll 2*a,c*, in such a way that a region 11.2*a,c* of the introduced initial cutting piece 11*a,c* which is not covered by the web 3*a,c*, (or by the transfer strip 10*a,c* of the web 3*a,c*). The region preferably covered by the transfer strip 10*a,c* is designated by the reference symbol 11.3*a,c*.

In the further variant of the method, the nip N2*a,c* formed by the winding roll 2*a,c* and the new core 6*a,c* is reached by the initial cutting piece 11*a,c*. In this nip, the initial cutting piece 11*a,c* is connected to the new core 6*a,c* in its region 11.2*a,c*. In this case, it is possible to use as a type of connection, which can be, e.g., a touch-and-close, form-fitting, welded, or another connection which is utilized in addition to or in place of an adhesive connection.

As already explained, at least one transfer strip 10*a,c* can be formed in the web 3*a,c*. According to the invention, this formation of a transfer strip 10*a,c*, preferably produced by way of at least one cutting device 9*a,c*, is not absolutely necessary for implementing the method according to the invention. This fact also applies to the description of the further figures.

Figure 3:
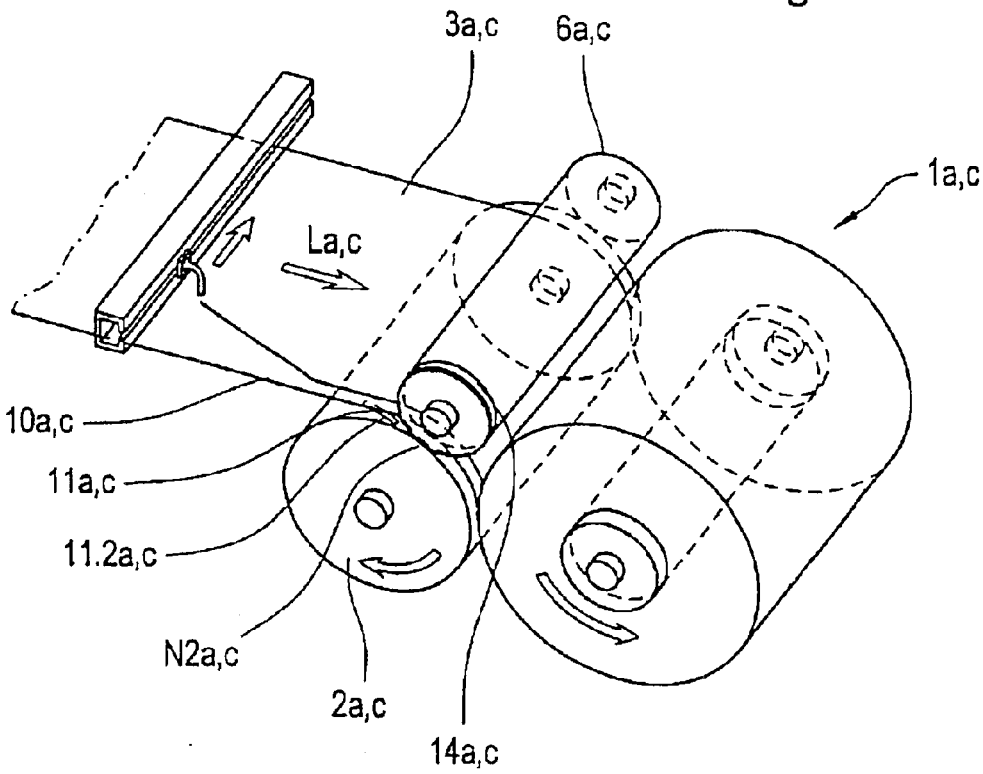

FIG. 3 illustrates that the possibilities of configuring a connection of this type are not limited to the region 11.2*a,c* of the initial cutting piece 11*a,c*, but can also be configured optimally on the new core 6*a,c* in accordance with the type of connection. As an example of this, a circumferential region 14*a,c* of the roll 6*a,c* can be fitted with plastic-bonded permanent magnets. Such an arrangement allows for a connection which utilizes magnetic forces.

Likewise in the region of the nip N2*a,c* which, in the examples illustrated in FIGS. 2–5, is identical to the point 10*a,c* at which the web 3*a,c* runs off (See FIGS. 12 to 14) the transfer strip 10*a,c*, then enclosed between the new core 6*a,c* and the initial cutting piece 11*a,c*, is severed by the initial cutting piece 11*a,c*. This leads to the formation of a "new web start". The term "new web start" designates the transfer strip 10*a,c* which is substantially completely severed and bonded to the new core and the initial cutting piece 11*a,c*.

Figure 4:
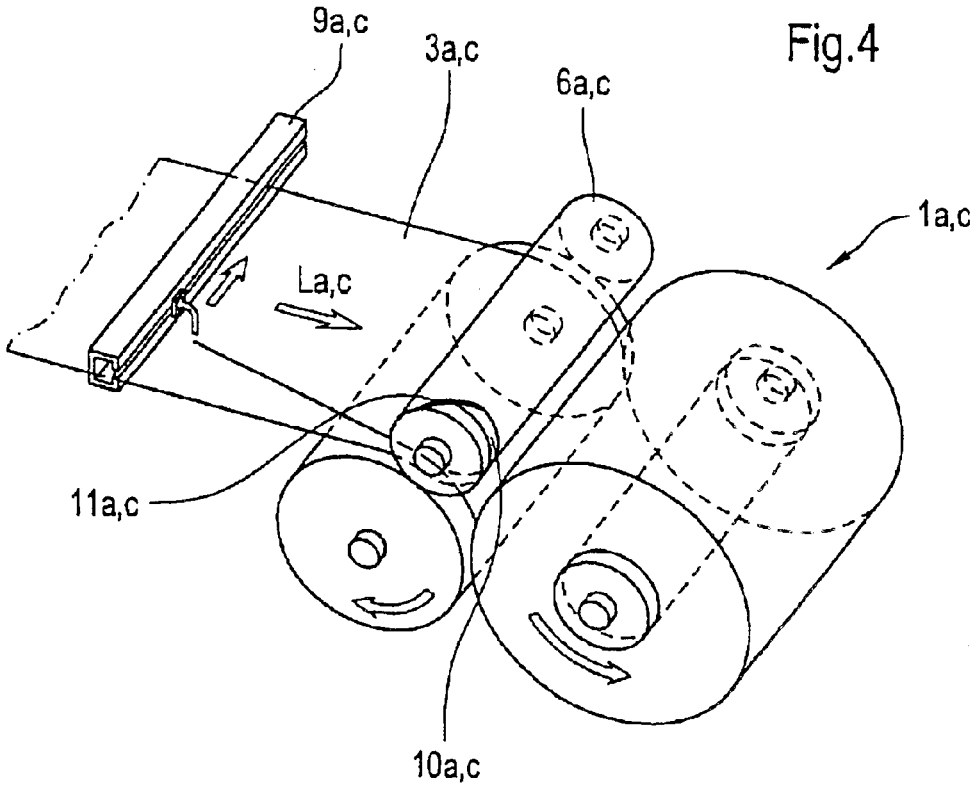

In FIG. 4, the new web start is shown transferred in a defined manner to the new core 6*a,c* during the initial revolution. Furthermore, FIG. 4 reveals how the width of the transferred web start is enlarged by way of the cutting device 9*a,c*.

FIG. 5 shows an advanced state of the method, in which the moving web 3*a,c* has been severed virtually completely by way of the cutting device 9*a,c* and transferred to a corresponding extent to the new core 6*a,c*.

FIG. 6 shows an embodiment according to the invention of the winder 1*a,c* in a schematic side view.

The introduction of an initial cutting piece 11*a,c* between the transfer strip 10*a,c* and the winding roll 2*a,c* is implemented, according to the invention, in a direct or indirect way by way of one of the dispensing devices 12*a,c*, 12.1*a,c* or 12.2*a,c*. Each dispensing device has, for example, the form and the function of a paper magazine of a plotter or of a printer with multiple or individual sheet feed.

In a preferred embodiment, provision is made for one or more of the dispensing devices to be arranged in such a way that the initial cutting piece 11*a,c* can be introduced substantially directly between the transfer strip 10*a,c* and the winding roll 2*a,c*. The advantageous feature in this arrangement, in addition to the simple configuration of the dispensing device 12*a,c* and of the initial cutting piece 11*a,c*, relates to the speed at which the initial cutting piece 11*a,c* can be introduced. This speed can be several times lower than the web speed. Furthermore, it is possible to dispense entirely with special guidance of the initial cutting piece 11*a,c*, since adequate guiding can also occur on the way to the nip N2*a,c* by the transfer strip 10*a,c* and the winding roll 2*a,c*.

As an alternative to this, the dispensing device 12.1*a,c* can be arranged in such a way that the initial cutting piece 11*a,c* is initially be applied to the underside of the transfer strip 10*a,c* or the web 3*a,c*. Then, it is introduced between the transfer strip 10*a,c* and the winding roll 2*a,c* by way of the web 3*a,c* and/or the transfer strip 10*a,c*. In particular, when space is restricted and/or is otherwise limited, this variant provides a good possible way of introducing the initial cutting piece 11*a,c*. The dispensing device 12.2*a,c* can also be arranged in such a way that, in the case of a temporary connection, the initial cutting piece 11*a,c* is initially applied to the circumferential surface 4*a,c* of the winding roll 2*a,c* and thereafter introduced between the transfer strip 10*a,c* and the winding roll 2*a,c* by way of the winding roll 2*a,c*. The temporary connection can, for example, be implemented in or otherwise have the form of an adhesive connection á la "Post it". It can also be formed with the use of an evacuated winding roll of the type disclosed in German laid-open specification DE 198 22 052 A1, i.e., by way use of a vacuum. The disclosure of DE 198 22 052 is hereby expressly incorporated by reference in its entirety. In addition, there is the possibility of providing a suitable dispensing device in the extension of the winding roll 2*a,c*, as is conventional in the case of known cable pulleys. Each of these variants may be advantageous, depending on the guidance of the web 3*a,c*, the webs properties, and on the special features of the winder.

The cutting device 9*a,c* can, according to the prior art, be arranged either on the top side or underside of the web 3*a,c* upstream of the nip N2*a,c*, and can have at least one cutting element. This can preferably be a cutting element which utilizes a jet or beam with a high power intensity. In particular, it can be a water-jet or laser-beam cutting element. Since no uniquely preferred arrangement of the cutting device 9*a,c* exists, the result, as can clearly be seen from FIG. 6, is a very large number of possible combinations in the arrangement of the dispensing device 12*a,c*, 12.1*a,c*, 12.2*a,c* and the cutting device 9*a,c* with the winder 1*a,c*.

Figure 7:
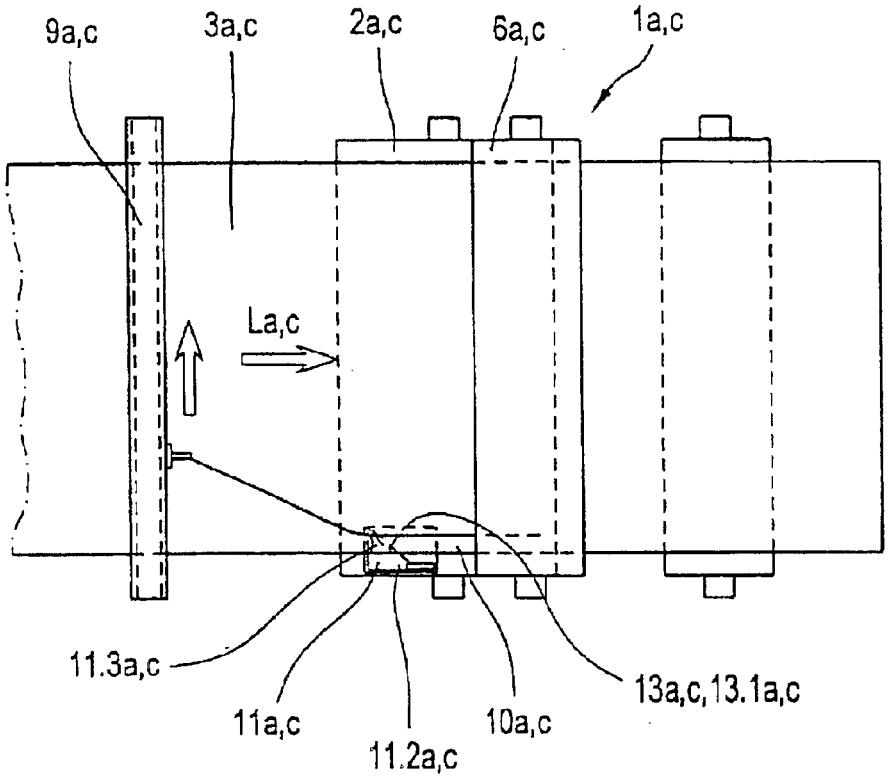
FIG. 7 shows a schematic plan view of a winder according to an embodiment according to the invention.

FIG. 7 shows a schematic plan view of a winder 1*a,c* according to an embodiment according to the invention.

Irrespective of whether the initial cutting piece 11*a,c* is introduced directly or indirectly between the transfer strip 10*a,c* and the winding roll 2*a,c* by way of a dispensing device, at least one portion or region 11.2*a,c* of the initial cutting piece 11*a,c* is intended not to be covered by the transfer strip 10*a,c*. While this region is important for providing a connection between the initial cutting piece 11*a,c* and the new core 6*a,c*, the region 11.3*a,c* of the initial cutting piece 11*a,c* covered by the transfer strip 10*a,c* is used primarily for cutting the transfer strip 10*a,c* and forming a new web start. For this purpose, the initial cutting piece 11*a,c* can be provided with at least one suitable cutting arrangement or system and/or a cutting contour 13*a,c*, 13.1*a,c*.

Figure 8:
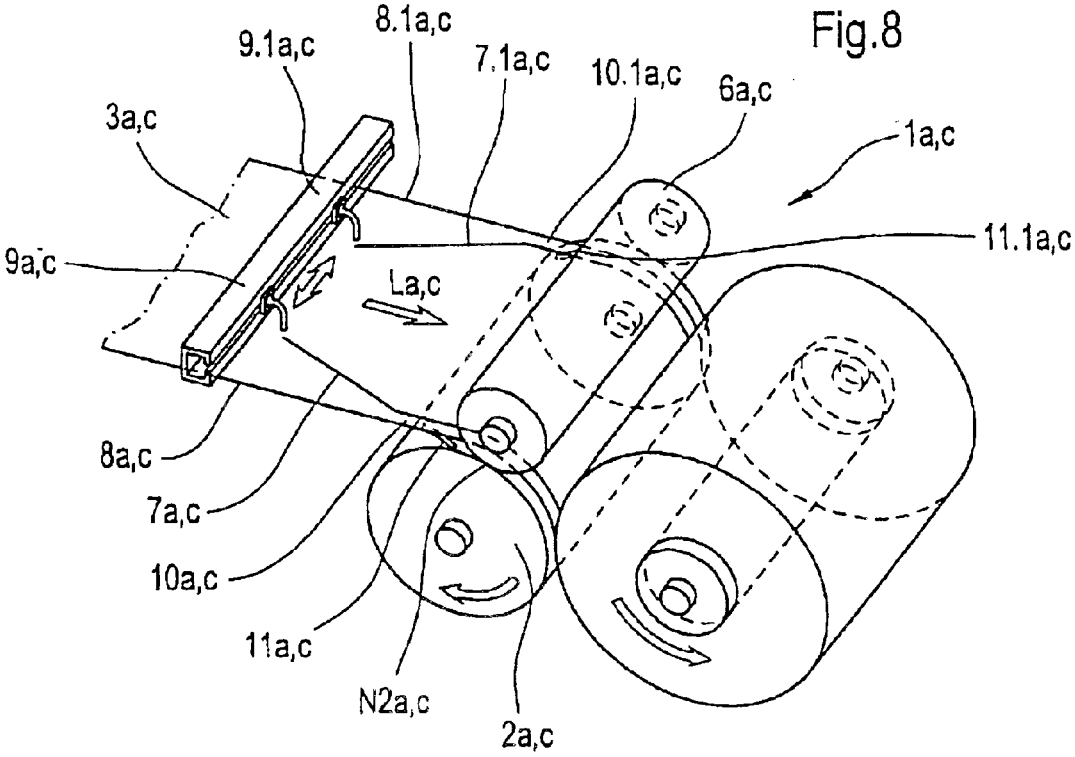
FIG. 8 shows a schematic and perspective illustration of a winder according to a further embodiment according to the invention.

FIG. 8 shows a schematic and perspective illustration of a winder 1*a,c* according to a further embodiment according to the invention.

The invention here provides for two cuts 7*a,c*, 7.1*a,c* which are made in both edge regions 8*a,c*, 8.1*a,c* of the material web 3*a,c* by way of known cutting devices 9*a,c*, 9.1*a,c*. At least one of these devices can be, in particular, a transverse cutting device. The arrangement shown in FIG. 8 produces two transfer strips 10*a,c*, 10.1*a,c*. Each transfer strip also utilizes an initial cutting piece 11*a,c*, 11.1*a,c* which is introduced directly or indirectly between the transfer strip 10*a,c*, 10.1*a,c* and the winding roll 2*a,c* in each case by way of a dispensing device (not shown). In each case, a region 11.2*a,c* of the initial cutting piece 1 1*a,c* respectively introduced is not covered by the transfer strip 10*a,c*, 10.1*a,c* of the web 3*a,c*. The initial cutting pieces 11*a,c*, 11.1*a,c*, after reaching the nip N2*a,c*, are connected to the new core 6*a,c*. At the latest, at the point Qa,c at which the web 3*a,c* runs off the new core 6*a,c*, the transfer strips 10*a,c*, 10.1*a,c* are severed by the respective initial cutting pieces 11*a,c*, 11.1*a,c*. As a result, for each initial cutting piece, a new web start is bonded to the initial cutting piece and the new core 6*a,c* is formed. The width of the web start which is respectively transferred to the new core 6*a,c* is enlarged in a known manner by way of the cutting device 9*a,c*, 9.1*a,c*. This occurs in such a way that the entire web 3*a,c* is transferred to the new core.

Figure 9:
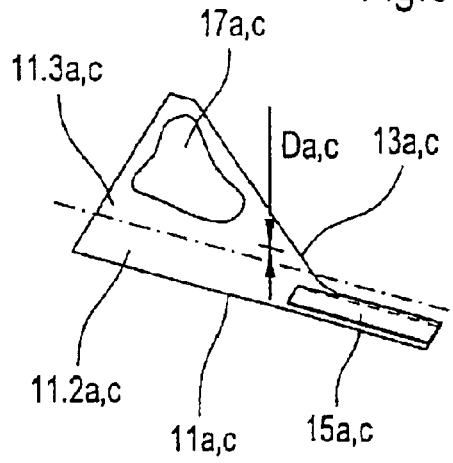
FIGS. 9 to 11 show schematic and perspective illustrations of one of the possible embodiments of the initial cutting piece according to the invention.

An exemplary embodiment of the initial cutting piece 11*a,c* according to the invention is revealed by FIG. 9.

Essentially, the initial cutting piece 11*a,c*, whose thickness is designated by symbol Da,c is formed as a molded member and is made of e.g., a plastic, a metal, a textile material or a fibrous material. Since the formation of a connection between the initial cutting piece 11*a,c* and the new core relates to an important aspect of at least one method according to the invention, the initial cutting piece 11*a,c* for this connection is provided with a connection system or arrangement 15*a,c*. In such a connection, it is possible for these connection arrangements to extend over only one part and/or portion of the initial cutting piece 11*a,c*, or alternatively, they can extend over a number of parts or portions, or even over all portions of a surface of the initial cutting piece 11*a,c*. Only in the case of adhesives, is a virtually unlimited range of connection systems available with which such a connection can be produced. From the point of view of a reusing of the cores, very good results can be achieved with adhesives and, in particular, with removable adhesives, similar to Tesa Powerstrip from the Beiersdorf company. The use of hot-melts, which have neutral adhesive properties at ambient temperature and become capable of forming a connection only after reaching a specific temperature, are also very interesting, especially from the point of view of automated handling and supply of the initial cutting pieces to the dispensing device. For example, an initial cutting piece tailor-made with hot-melt adhesive (and/or pre-formed with hot-melt adhesive) can be supplied simply and reliably from a storage cartridge to the actual dispensing device. This supplying can occur in a manner similar to the way individual sheets are fed in a commercially available printer. Moreover, with such an arrangement the desired adhesive properties can be activated at a later time by supplying heat. In this way, given a suitable, reactive hot-melt, it is also possible for an only temporary connection, existing at least for the period of an initial revolution, to be produced between the initial cutting piece and the new core. Comparable advantages can also be achieved by using encapsulated adhesives, which are activated only by the exertion of a specific pressure, e.g., pressure sensitive adhesives. The enumeration of all suitable types of connection systems and/or arrangements, with detailed description of the advantages resulting therefrom, is not critical for the instant invention and would certainly go beyond the context of this specification. For this reason, it should be noted only generally that this connection can have many forms such as, e.g., a form-fitting connection, in particular a touch-and-close connection, as a welded connection, in particular a thermal welded connection, or as a magnetic connection. The connection used should provide for connecting the initial cutting piece to the new core and should fulfill its intended purpose.

One object of the initial cutting piece provides, inter alia, for cutting the transfer strip and, in a large number of webs, can be carried out by way of an edge formed as a cutting contour 13*a,c*. A new web start can be bonded to the initial cutting piece 11*a,c* and the new core and can be formed by the transfer strip enclosed between the new core and the initial cutting piece 11*a,c*. This start can be cut by the initial cutting piece 11*a,c* substantially completely as a result of tearing along the cutting contour 13*a,c*. In order to make the tearing progressive and, as a result, reliable, the appropriate edge can be formed at an angle which is matched to the tearing behavior of the web. Because of the method, the new web start is enclosed between the new core and the initial cutting piece 11*a,c*, and therefore is already bonded to the latter. In order to improve the connection of the new web start to the initial cutting piece 11*a,c*, the piece can additionally be provided with an adhesive region 17*a,c*. The invention can also provide, for example, for the indirect introduction of the initial cutting piece between the transfer strip and the winding roll by way of a dispensing device. On its rear surface, the initial cutting piece 11*a,c* can also be provided with a suitable connection system and/or arrangement (not shown). This connection can provide a temporary connection between the initial cutting piece and the winding roll and can be produced if the initial cutting piece is introduced indirectly between the transfer strip and the winding roll by way of a dispensing device. Furthermore, in FIG. 9, there is shown the region 11.2*a,c* which not covered by the transfer strip and also the region 11.3 which is covered by the transfer strip and belonging to the initial cutting piece 11. This initial cutting piece just described can also be used in anyone or more of the embodiments shown in the other figures.

Figure 10:
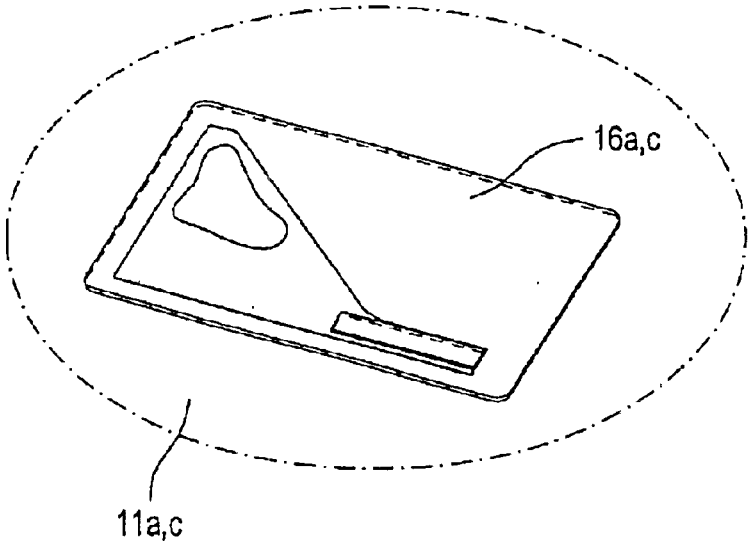

FIG. 10 shows a further embodiment of the initial cutting piece 11*a,c* according to the invention.

Many disadvantages of the known prior art are avoided by the initial cutting piece 11*a,c* being formed from an extremely thin material. According to the invention, provision is made for the initial cutting piece 11*a,c*, before being introduced between the transfer strip (not shown) and the winding roll (not shown) to be applied by way of a relatively easily detachable connection to at least one carrier 16*a,c*. In this case, the carrier 16*a,c* is not carried along with the new core when after the formation of a new web start that is bonded to the initial cutting piece 11*a,c* and the new core. The advantage of an initial cutting piece 11*a,c* formed as a composite object or device resides in the virtually unlimited configuration freedom of its physical and mechanical properties. For example, the material thickness Da,c can be reduced without regard to the stiffness of the initial cutting piece connected to it, since the stiffness required for process reasons can be achieved by the carrier 16*a,c*. Furthermore, the carrier 16*a,c* can be formed in such a way that the introduction of the initial cutting piece 11*a,c* between the transfer strip and the winding roll by way of a dispensing device can be carried out in an automated manner and also in an absolutely reliable manner.

Figure 11:
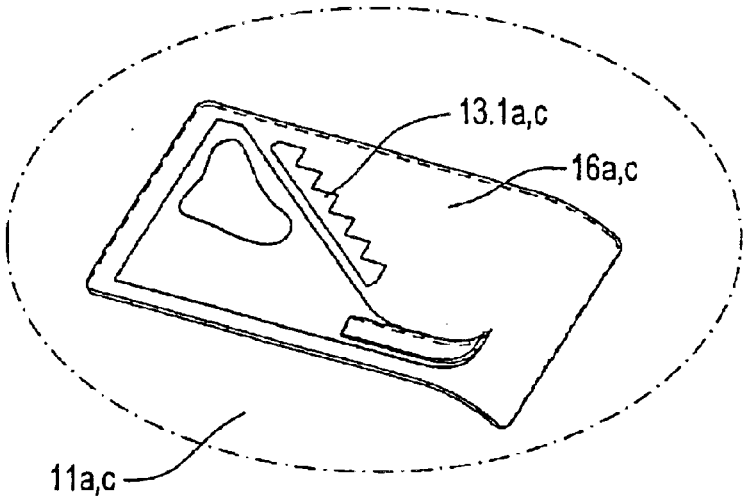

A further advantage of an initial cutting piece 11*a,c* formed as a composite object is illustrated in FIG. 11.

For some applications, in particular, for transferring webs with a high tearing strength, according to the invention the initial cutting piece 11*a,c* can be configured with an arrangement or system 13.1*a,c* for cutting the transfer strip, with which the new web start is formed by, e.g., punching, cutting, pressing or embossing, or by a combination thereof. This can occur with the aid of the forces prevailing in the nip or by way of at least one auxiliary device (not shown), but which can additionally be arranged upstream of the nip. During the transfer of webs 3*a,c* which have a defined melting point behavior (e.g., a plastic web), the heat for cutting the transfer strip can also be applied by the initial cutting piece 11*a,c*. This can occur by configuring the initial cutting piece with an electric resistance wire and using it as a cutting system 13.1*a,c*. The energy necessary for producing heat can also be transmitted without contact, for example, by way of an inductive route. This can also occur, preferably immediately upstream of the nip, by way of a known device (not shown). FIG. 11 likewise illustrates the fact that the relatively easily detachable connection between the initial cutting piece and the carrier 16*a,c* can be detached, for example, as soon as a new web start which bonded to the initial cutting piece 11*a,c* and the new core, is formed. As a result of such an arrangement, the carrier 16*a,c* can be deliberately not carried along with the new core.

Figure 12:
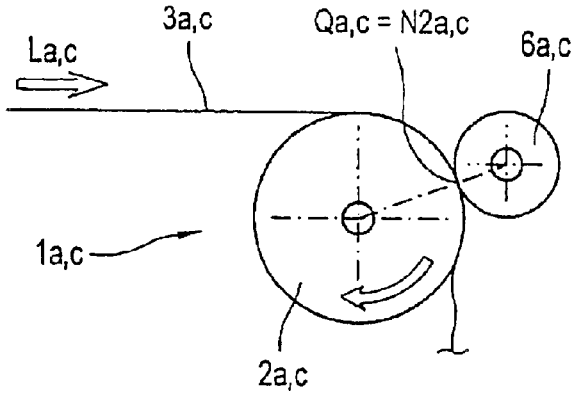
FIG. 12 shows a schematic side view of a winder as the web is being led onto a new core, for example after a break.
Figure 13:
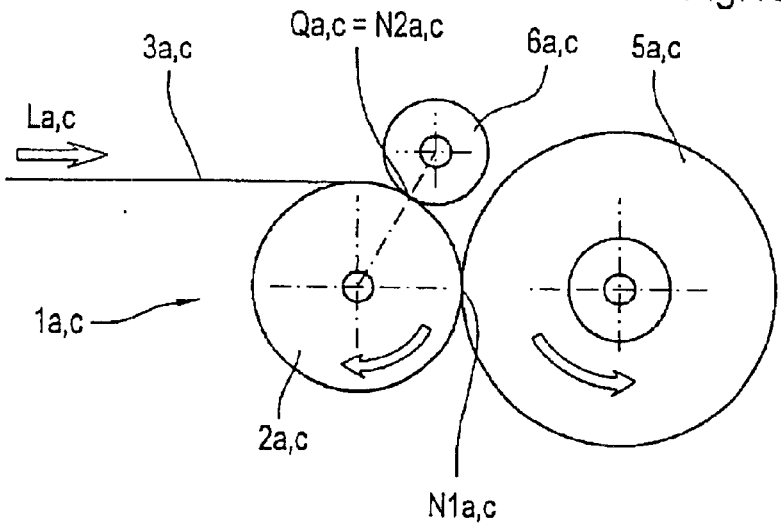
FIGS. 13 to 14 show schematic side views of two different winders as the web is being led on to a new core during a reel change.
Figure 14:
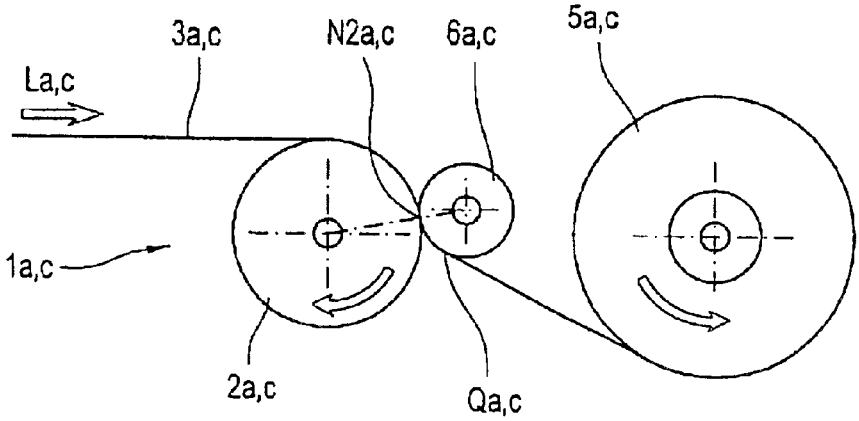

FIGS. 12 to 14 make clear not only the principal difference between the point Qa,c at which the web 3*a,c* runs off the new core 6*a,c* and the nip N2*a,c* formed between the winding roll 2*a,c* and the new core 6*a,c*, but also the fact that the onward guidance of the web 3*a,c* downstream of the nip N2*a,c* has no fundamental influence on the method. Thus, the method can be used universally for all types of winders currently established in practice.

FIG. 12 shows a schematic side view of a winder 1*a,c* as a web 3*a,c* is being led onto a new core 6*a,c* in a state which arises sporadically, for example, following a break in the web 3*a,c*. The wound reel is normally then removed from the winder 1*a,c* and the web 3*a,c* is supplied to a collecting container (not shown). Since the new core 6*a,c* is not wrapped around by the web 3*a,c*, the point Qa,c at which the web 3*a,c* runs off the new core 6*a,c* is generally or essentially identical to the nip N2*a,c* formed between the winding roll 2*a,c* and the new core 6*a,c*.

FIG. 13 shows a schematic side view of a winder 1*a,c* as a web 3*a,c* is being led onto a new core 6*a,c* during a reel change. When the wound reel 5*a,c* forming the nip N1*a,c* together with the winding roll 2*a,c* has reached a predetermined diameter. The web 3*a,c* is led onto the new core 6*a,c* without interrupting the manufacturing process. In this arrangement, the web 3*a,c* does not wrap around the new core 6*a,c* and the run-off point Qa,c is identical to the nip N2*a,c*.

In FIG. 14, which shows a schematic side view of a winder 1*a,c* of the alternative design as a web 3*a,c* is led onto a new core 6*a,c* during a reel change, the new core 6*a,c* is wrapped around by the web 3*a,c*. As a result, the point Qa,c at which the web 3*a,c* runs off the new core 6*a,c* is not identical to the nip N2*a,c* formed between the winding roll 2*a,c* and the new core 6*a,c*.

Figure 15:
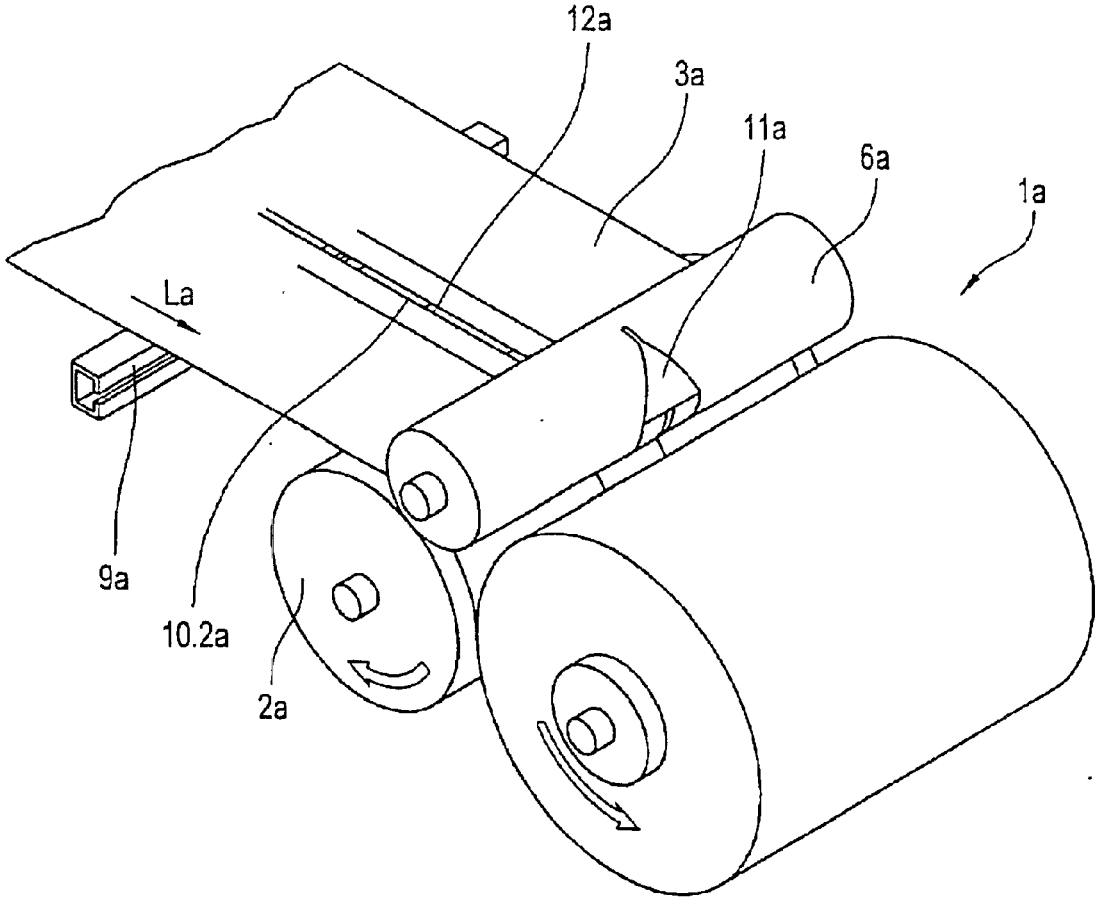
FIG. 15 shows a schematic and perspective illustration of a winder according to a further embodiment according to the invention.

FIG. 15 shows a schematic and perspective illustration of a winder according to a further embodiment according to the invention. The construction together with control technology of this winder 1*a* corresponds in principle to that of the winder 1*a* of FIG. 1, with which a reference is made to FIG. 1.

According to the invention, the initial cutting piece 11*a* can be introduced in any desired region of the web 3*a* to be transferred to a new core 6*a*. For example, in FIG. 15—as viewed in the running direction La—a strip 10.2*a* is separated out from the web 3*a* upstream of the winding roll 2*a* by way of a cutting device 9*a* indicated only schematically. This formed strip 10.2*a* is preferably led away by way of a device (not shown), such as an extraction device. In the region of the led away strip 10.2*a*, the at least one initial cutting piece 11*a* is then introduced in the manner already described by way of at least one dispensing device 12*a*. The additional method sequence has already been described extensively; accordingly, reference is hereby made thereto.

Figure 16:
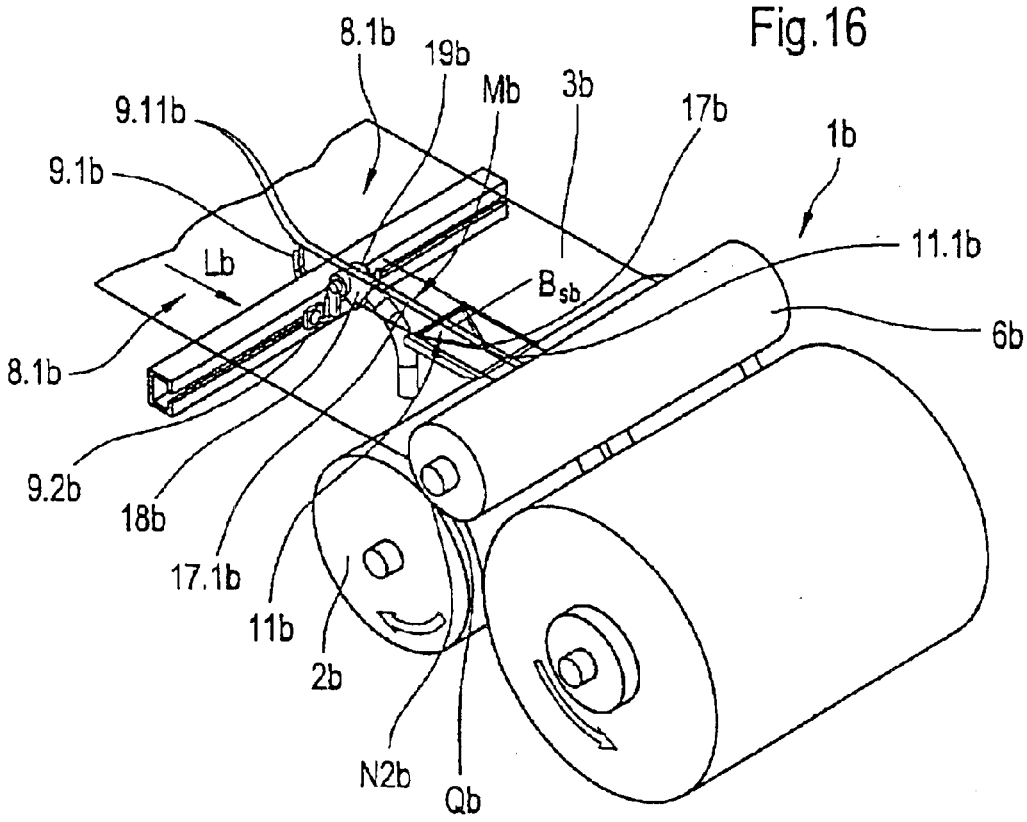
FIGS. 16 to 18 show schematic and perspective illustrations of a winder according to a first embodiment according to the invention.
Figure 17:
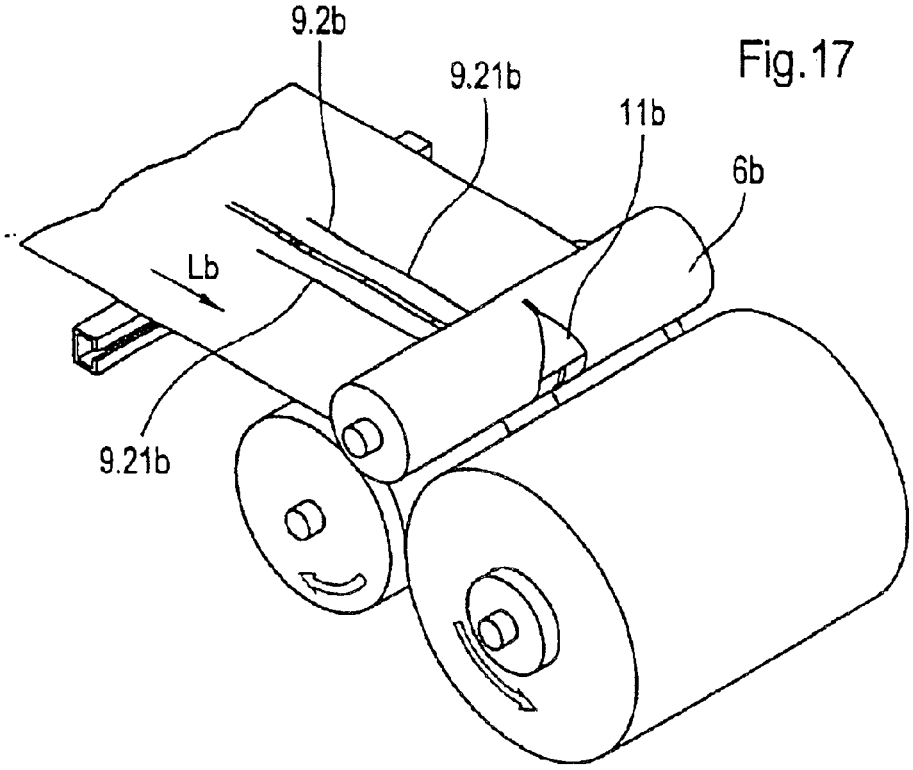
Figure 18:
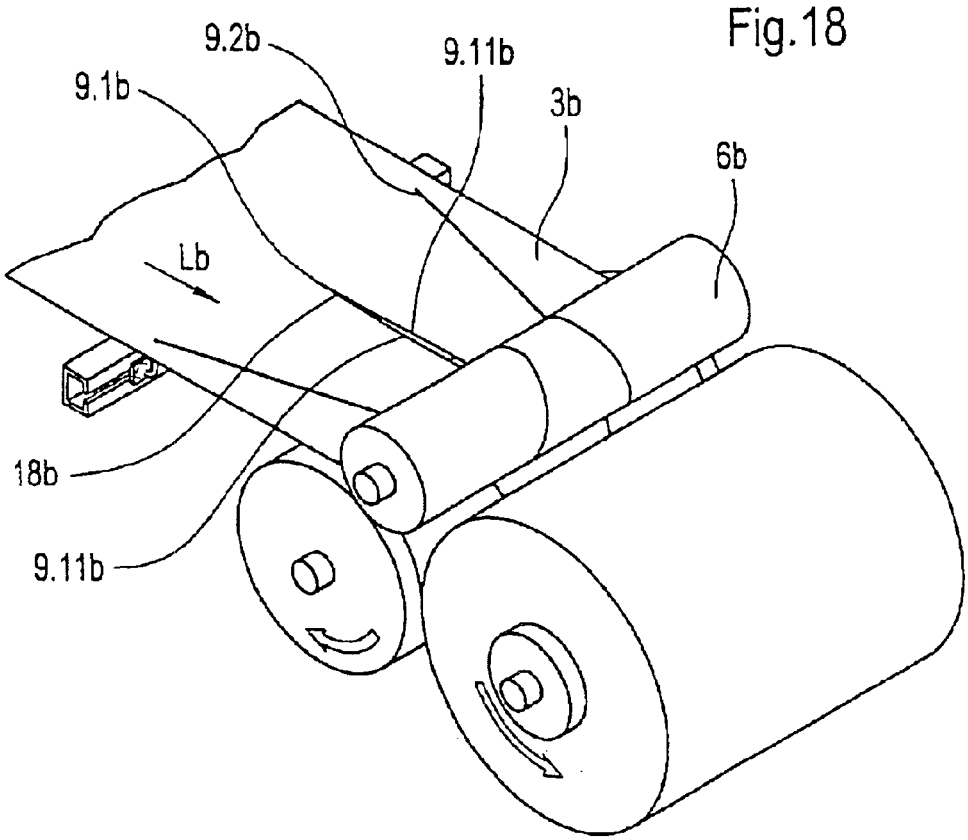

FIGS. 16 to 18 show schematic and perspective illustrations of a winder 1*b* according to a further embodiment of the invention. Here, the construction together with control technology correspond in principle to that of the winder 1*a* of FIG. 1, with which a reference is made to FIG. 1. The web 3*b* is illustrated in transparent form, so that the components and subassemblies lying underneath are visible.

The invention provides that, as illustrated in FIG. 16, at least one opening 17*b*, in particular, a slit or an introduction area 17.1*b*, is produced. This can occur preferably in the center Mb of the web 3*b* and can be created preferably by way of a first cutting device 9.1*b*. In the region of the introduction area 17*b*, at least one initial cutting piece 11*b* is introduced between the web 3*b* and the winding roll 2*b* in such a way that a region 11.1*b* of the initial cutting piece 11*b* introduced is not covered by the web 3*b*. The initial cutting piece 11*b*, after reaching a nip N2*b* formed by the winding roll 2*b* and the new core 6*b*, is connected to the new core 6*b*, at least temporarily, in the uncovered region 11.1*b*. At the latest, at the point Qb at which the web 3*b* runs off the new core 6*b*, cutting of the web 3*b* by the initial cutting piece 11*b* is effected and/or made possible. As a result of this arrangement, at least two new web starts bonded to the initial cutting piece 11*b* and the new core 6*b* are formed.

The at least one introduction area 17.1*b* is preferably produced by way of the first cutting device 9.1*b* by forming at least one removal strip 18*b*.

In a further refinement (which is not illustrated) the introduction area 17.1*b* can also be produced in the central region of the web 3*b*, lying between the two edge regions 8.1*b*. In addition, at least one introduction area 17.1*b*, and preferably two introduction areas 17.1*b*, can be produced in the two edge regions 8.1*b* of the web 3*b*. With such an arrangement the transfer of the web 3*b* can advantageously be accelerated.

The at least one removal strip 18*b*, having a strip width $B_{Sb}$ in the range from between approximately 10 mm to approximately 250 mm, in particular from between approximately 25 mm to approximately 100 mm, is produced by way of a first cutting device 9.1*b*, and is led away directly after its production by way of at least one removal device 19*b* having a vacuum in the range of between approximately 0.01 bar to approximately 0.2 bar, preferably between approximately 0.05 bar to approximately 0.1 bar. This removal device 19*b* can, in the simplest case, be designed as a conventional suction hose. On the outgoing run of the removal device 19*b* there can advantageously be arranged at least one cutting device, preferably a cutting edge, for the single and initial cutting of the removal strip 18*b*.

In the further stage of the method, the nip N2*b* formed by the winding roll 2*b* and the new core 6*b* is reached by the initial cutting piece 11*b*, in which nip the initial cutting piece 11*b* is connected to the new core 6*b* in the region 11.1*b* of the initial cutting piece, at least temporarily and sufficiently firmly by way of a connection. This connection to the new core 6 can be, e.g., an adhesive, vulcanization, touch-and-close, suction stud, form-fitting, frictional-fitting or welded connection or a magnetic or electrostatic connection.

As already mentioned, the removal strip 18 is produced by a first cutting device 9.1*b*. In this case, the start of the cut of the cutting lines 9.11*b* of the removal strip 18*b* can be produced in parallel and/or at the same time. They can be formed in point form and can become enlarged and/or can be formed in a crossing and enlarging manner. Since this type of cut web start creation is similar to that already known prior art, this will not be discussed further at this point. Instead, reference is made, for example, to the European patent application EP 0 543 788 A1 already mentioned.

Furthermore, the first and/or the second cutting device 9.1*b*, 9.2*b* can be arranged in a common subassembly with preferably common components, in particular a common carrier.

In addition, the formation of only one opening in the form of a cut is sufficient to provide the precondition for the production of a sufficiently large area for the introduction of an initial cutting piece. The sufficiently large area can be created, for example, by way of an element that dips into the cut and has an external contour that widens in the running direction of the web, or by guiding the cut web over a spreader roll.

In FIG. 17, the initial cutting piece 11*b* transferred to the new core 6*b*, together with its two new web starts, is illustrated explicitly during the initial revolution.

Furthermore, it can clearly be seen that, by way of a second cutting device 9.2*b*, at least two further cutting lines 9.21*b*, whose spacing is preferably smaller than the width of the initial cutting piece, are produced. The cutting lines 9.21*b* initially preferably run parallel to each other.

FIG. 18 shows the continuation of FIG. 17. The widths of the web starts transferred to the new core 6*b* are now enlarged by way of a second cutting device 9.2*b* in such a way that the entire web 3*b* is transferred to the new core 6*b*. The production of the transfer strip 18*b* is stopped, preferably by bringing the two cutting lines 9.11*b* together or by switching off the first cutting device 9.1*b*.

The second cutting device 9.2*b* is preferably moved relative to the web 3*b* in a plane approximately parallel to the web 3*b*, preferably at least substantially perpendicular to the running direction Lb of the web 3*b*, so that oblique cutting lines 9.21*b* are produced.

The moving web 3*b* has then been severed virtually completely in FIG. 18 by way of the second cutting device 9.2*b* and transferred to a corresponding extent to the new core 6*b*.

Figure 19:
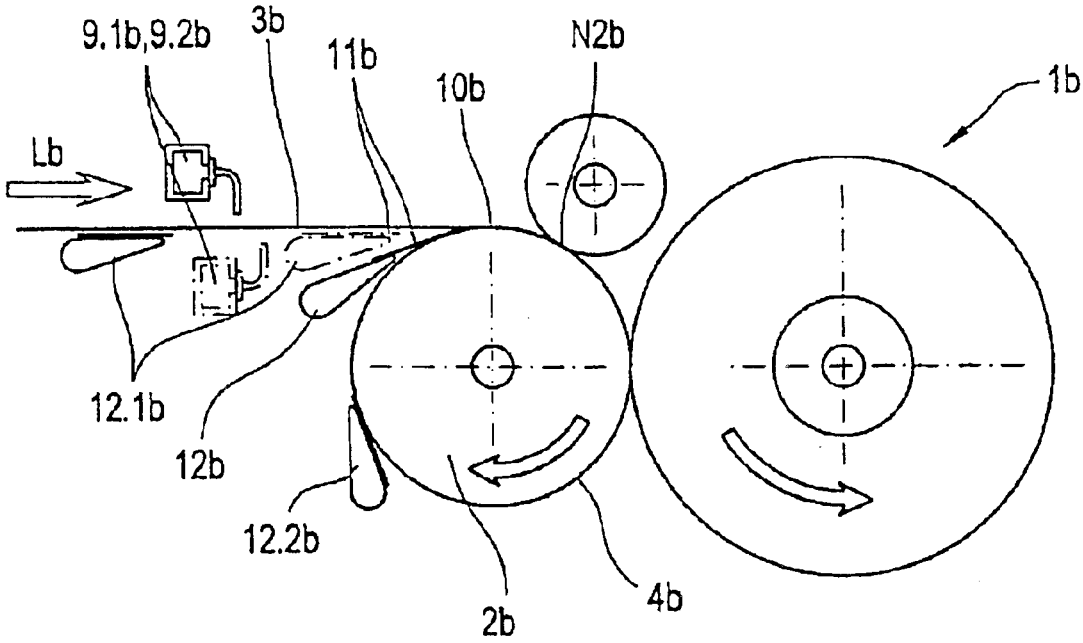
FIG. 19 shows an embodiment according to the invention of the winder in a schematic side view.

FIG. 19 shows an embodiment according to the invention of the winder 1*b* in a schematic side view.

The introduction of an initial cutting piece 11*b* between the web 3*b* and the winding roll 2*b* in such a way that a region of the initial cutting piece 11*b* is not covered by the web 3*b* is implemented, according to the invention, in a direct or indirect way by way of one or more of the dispensing devices 12*b*, 12.1*b* or 12.2*b*. The dispensing devices 12*b*, 12.1*b* or 12.2*b* may have, for example, the form and the function of a paper magazine of a plotter or of a printer with multi-sheet or individual sheet feed.

At least one preferred embodiment provides for the dispensing device 12*b* to be arranged in such a way that the initial cutting piece 11*b* can be introduced substantially directly between the web 3*b* and the winding roll 2*b*. The advantage of this arrangement, apart from the simple configuration of the dispensing device 12*b* and of the initial cutting piece 11*b*, is also the speed at which the initial cutting piece 11*b* can be introduced. This can be many times lower than the web speed. Furthermore, it is also possible to dispense entirely with special guidance of the initial cutting piece 11*b*, since guiding can also occur adequately by the web 3*b* and the winding roll 2*b* on the way to the nip N2*b*.

As an alternative to this, the dispensing device 12.1*b* can be arranged in such a way that the initial cutting piece 11*b* can initially be applied to the underside of the web 3*b* and can then be introduced between the web 3*b* and the winding roll 2*b* by way of the web 3*b*. In particular, when space is restricted, this variant offers a good possible way of introducing the initial cutting piece 11*b*. The dispensing device 12.2*b* can also be arranged in such a way that, in the case of a temporary connection, the initial cutting piece 11*b* can initially be applied to the circumferential surface 4*b* of the winding roll 2*b* and can then be introduced between the web 3*b* and the winding roll 2*b* by way of the winding roll 2*b*. The temporary connection can be implemented, for example, in the form of an adhesive connection á la "Post it". The connection can also be created with an evacuated winding roll, which has been disclosed by German laid-open specification DE 198 22 052 A1, i.e., by utilizing a vacuum. In addition, there is the possibility of providing a suitable dispensing device in the extension of the winding roll 2*b*, as is normally the case in known rope pulleys. Each of these variants may be advantageous, depending on the guidance of the web 3*b*, its properties and the special features of the winder.

In a further refinement of the invention (not shown), it is also possible for the dispensing device to be fitted in a region above the web and to introduce the initial cutting piece, as already explained, directly or indirectly between the web and the new core. In this case, the initial cutting piece can have the same contour but, on the other hand, one of more adhesive regions between the initial cutting piece and the web must be formed specifically, in particular, with respect to its adhesive effect.

The first and/or second cutting devices 9.1*b*, 9.2*b* can be arranged according to the prior art on the top side or underside of the web 3*b* upstream of the nip N2*b* and have at least one cutting element. This element can preferably be a cutting element with a jet or beam with a high power density, and can in particular be a water-jet or laser-beam cutting element.

Since there is no uniquely preferred arrangement of the first and/or second cutting devices 9.1*b*, 9.2*b*, the result, as can be seen clearly from FIG. 19, is an extremely large number of possible combinations in the arrangement of the dispensing devices 12*b*, 12.1*b*, 12.2*b*, and the first and/or second cutting devices 9.1*b*, 9.2*b* with the winder 1*b*.

Figure 20:
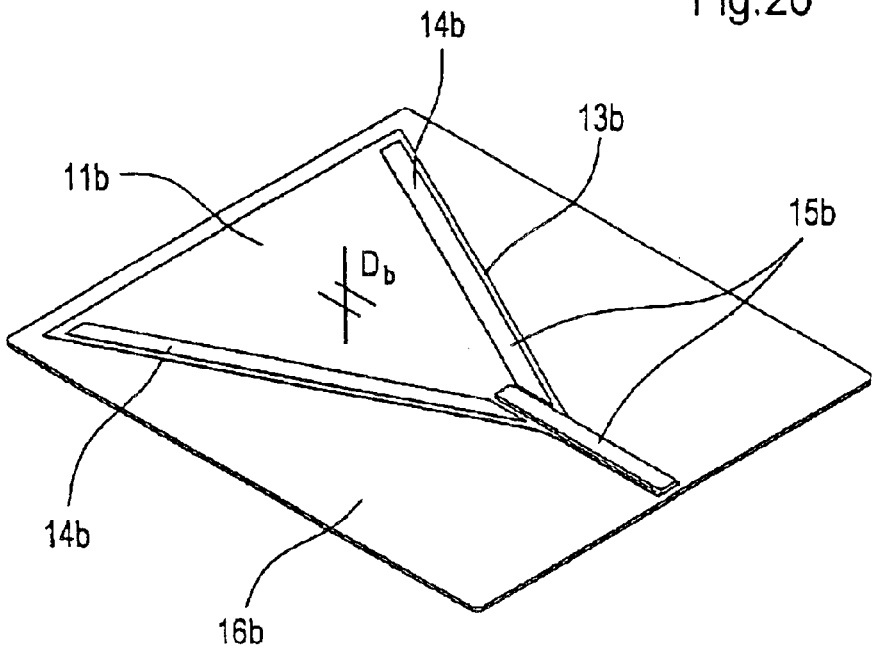
FIG. 20 shows a schematic and perspective illustration of one of the possible embodiments of the initial cutting piece according to the invention.

An exemplary embodiment of the initial cutting piece 11*b* according to the invention can be seen from FIG. 20.

Essentially, the initial cutting piece 11*b*, whose thickness Db lies in the range from between approximately 0.5 mm to approximately 0.05 mm, and preferably in the range from between approximately 0.25 mm to approximately 0.1 mm, is formed as a molded article and can be made of, e.g., a plastic, a metal, a textile material or a fibrous material. Since the formation of a connection between the initial cutting piece 11*b* and the new core relates, according to at least one embodiment of the invention, to an essential method stage, the initial cutting piece 11*b* for this connection is provided with a connection system 15*b*. In this regard, it is possible for these connection arrangements to extend over only one part or portion of the initial cutting piece 11*b*, over a number of parts, or over all of at least one surface of the initial cutting piece 11*b*. Only in the case of adhesives is a virtually unlimited range of connection arrangements available with which such a connection can be produced. From the point of view of reusing the reel cores, very good results are achieved, in particular, with removable adhesives, similar to Tesa Powerstrip from the Beiersdorf company. Especially since it is easy to remove such pieces from the reel cores prior them being reused. The use of hot-melts or hot-melt adhesive materials, which have neutral adhesive properties at ambient temperature and become capable of forming a connection only after reaching a specific temperature, are also very interesting—not only from the point of view of automated handling and supply of the initial cutting pieces to the dispensing device. For example, an initial cutting piece tailor-made with hot-melt can be supplied and/or fed simply and reliably from a storage cartridge to the actual dispensing device. This can occur in a manner similar to the individual sheet feed arrangement of a commercially available printer. With such an arrangement, the desired adhesive properties can be activated at a later time by supplying heat. In this way, given a suitable, reactive hot-melt, it is also possible for an only temporary connection, e.g., existing at least for the period of an initial revolution, to be produced between the initial cutting piece and the new core. Comparable advantages can also be achieved by the use of encapsulated adhesives, which are activated only by the exertion of a specific pressure. The enumeration of all suitable types of connection with detailed description of the advantages resulting therefrom is not critical for this invention, and would certainly go beyond the context of this specification. For this reason, it will be pointed out only generally that this connection can also be configured as a form-fitting connection, in particular, a connection of the following possible types; a touch-and-close connection, as a welded connection, in particular a thermal welded connection, or as a magnetic connection. These would allow the initial cutting piece to be connected to the new core and can fulfill its tasks.

One use of the initial cutting piece provides for, inter alia, cutting the transfer strip. In the case of a large number of webs, this can be carried out by way of an edge formed as a cutting contour 13*b*. A new web start can be bonded to the initial cutting piece 11*b* and the new core. In this way, the new web start can be formed by the transfer strip enclosed between the new core and the initial cutting piece 11*b* and can be cut substantially completely by the initial cutting piece 11*b* as a result of tearing along the cutting contour 13*b*. In order to make the tearing progressive, and, as a result, reliable, the appropriate edge can be formed at an angle matched to the tearing behavior of the web. Because of the method, the new web start is enclosed between the new core and the initial cutting piece 11*b* and therefore already bonded to the latter. In order to improve the bonding of the new web start to the initial cutting piece 11*b*, the latter can additionally be provided with one or more adhesive regions 14*b*, for example, which can also be used for the indirect introduction of the initial cutting piece between the transfer strip and the winding roll by way of a dispensing device. On its rear side, the initial cutting piece 11*b* can likewise be provided with suitable connection systems (not shown). This arrangement can provide a temporary connection between the initial cutting piece and the winding roll if and when, for example, the initial cutting piece is introduced indirectly between the transfer strip and the winding roll by way of a dispensing device.

Many disadvantages of the known prior art are avoided by utilizing an initial cutting piece 11*b* that is formed from an extremely thin material. According to the invention, provision is made for the initial cutting piece 11*b*, before being introduced between the web and the winding roll, is applied by way of a relatively easily detachable connection to at least one carrier 16*b*. After the formation of the new web start(s), the start(s) is/are bonded to the initial cutting piece 11*b* and the new core. However, the carrier 16*b* is not carried along with the new core. The advantage of an initial cutting piece 11*b* formed as a composite object (i.e., a separate piece 11*b* and a separate carrier 16*b* which are detachably connected to each other) consists in the virtually unlimited configuration freedom of its physical and mechanical properties. For example, the material thickness can then be reduced without regard to the stiffness of the initial cutting piece connected to it, since the stiffness required for process reasons can be achieved by the carrier 16*b*. Furthermore, the carrier 16*b* can be formed in such a way that the introduction of the initial cutting piece 11*b* between the web and the winding roll by way of a dispensing device can be carried out in an automated manner and absolutely reliably.

Furthermore, the initial cutting piece can be configured as a composite object having an arrangement for cutting the web, with which the new web start is formed by punching, cutting, pressing or embossing or by a combination thereof. This can occur with the aid of the forces prevailing in the nip or by way of at least one auxiliary device additionally arranged upstream of the nip (not shown). During the transfer of webs which have a defined melting point behavior, such as plastic webs, the heat for cutting the web can also be applied by the initial cutting piece (which can be configured with an electric resistance wire so as to provide a cutting arrangement). The energy necessary for producing heat can be transmitted without contact, for example, by an inductive route, preferably immediately upstream of the nip, by way of a known device (not shown). The relatively easily detachable connection between the initial cutting piece and the carrier can be detached, for example, as soon as a new web start bonded to the initial cutting piece and the new core is formed. As a result, the carrier is deliberately not carried along with the new core. With regard to the application and configuration of these arrangements, reference is made to the Applicant's German patent application DE 101 63 554.0 dated Dec. 21, 2001. The disclosure of this document is hereby expressly incorporated by reference in its entirety.

Figure 21:
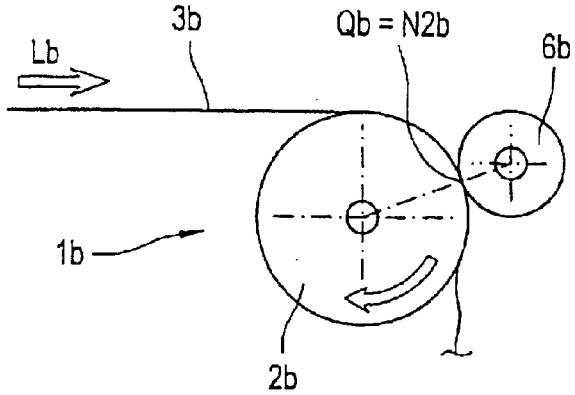
FIG. 21 shows a schematic side view of a winder as the web is being led onto a new core, for example after a break.
Figure 22:
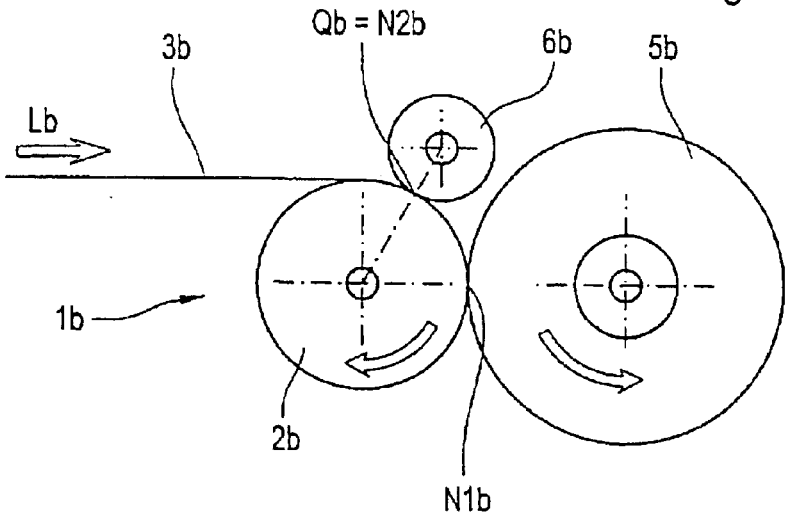
FIGS. 22 and 23 show schematic side views of two different winders as the web is being led onto a new core during a reel change.
Figure 23:
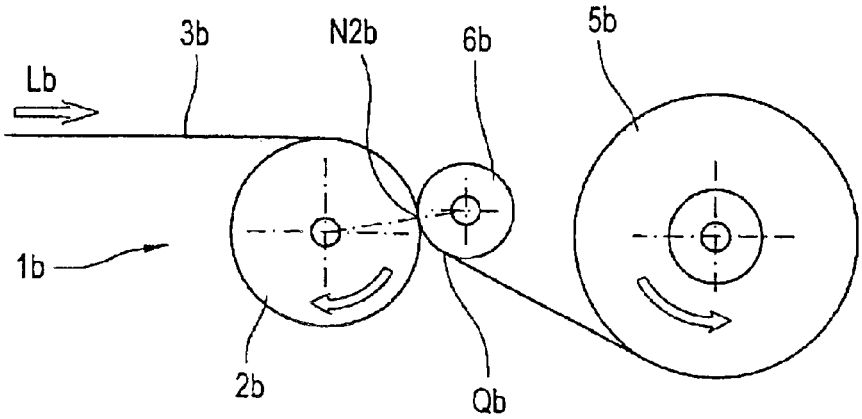

FIGS. 21 to 23 make clear not only the basic difference between the point Qb at which the web 3*b* runs off the new core 6*b* and the nip N2*b* formed between the winding roll 2*b* and the new core 6*b* but also the fact that the onward guidance of the web 3 downstream of the nip N2*b* has no fundamental influence on the method. Thus, the method can be used universally for all types of winder established in practice.

FIG. 21 shows a schematic side view of a winder 1*b* as a web 3*b* is being led onto a new core 6*b* in a state which arises sporadically, for example, following a break in the web 3*b*. The wound reel is normally then removed from the winder 1*b* and the web 3*b* is supplied to a collecting container (not shown). Since the new core 6*b* is not wrapped around by the web 3*b*, the point Qb at which the web 3*b* runs off the new core 6*b* is essentially identical to the nip N2*b* formed between the winding roll 2*b* and the new core 6*b*.

FIG. 22 shows a schematic side view of a winder 1*b* as a web 3*b* is being led onto a new core 6*b* during a reel change. When the wound reel 5*b* forming the nip N1*b* together with the winding roll 2*b* has reached a predetermined diameter, the web 3*b* is led on to the new core 6*b* without interrupting the manufacturing process. In this arrangement, the web 3*b* does not wrap around the new core 6*b* and the run-off point Qb is identical to the nip N2*b*.

In FIG. 23, which shows a schematic side view of a winder 1*b* of the alternative design as a web 3*b* is led onto a new core 6*b* during a reel change, the new core 6*b* is wrapped around by the web 3*b*, as a result of which the point Qb at which the web 3*b* runs off the new core 6*b* is not identical to the nip N2*b* formed between the winding roll 2*b* and the new core 6*b*.

In summary, it should be emphasized that the invention provides a method and a winder of the type mentioned above which permits optimum transfer of a moving web to a new core with high process safety, process efficiency and beneficial investment and operating costs, and which entirely avoids the disadvantages of the known prior art. Furthermore, the method can be applied to the same extent on virtually all known types of reel-ups and to a broad range of webs.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

LIST OF REFERENCE SYMBOLS

1*a,b,c* Winder
2*a,b,c* Winding roll
3*a,b,c* Web
4*a,b,c* Circumferential surface
5*a,b,c* Wound reel
5.1*a,c* Axis of rotation (wound reel)
6*a,b,c* New core (empty spool)
6.1*a,c* Axis of rotation (new core)
7*a,b,c*, 7.1*a,c* Cut
8*a,b,c*, 8.1*a,b,c* Web edge
9*a,b,c*, 9.1*a,b,c* Cutting device
9.11*b* Cutting line
9.2*b* Second cutting line
10*a,b,c*, 10.1*a,c* Transfer strip
10.2*a* Strip
11*a,b,c*, 11.1*a,b,c* Initial cutting piece
11.2*a,c* Region (not covered)
11.3*a,c* Region (covered)
12*a,b,c*, 12.1*a,b,c,*
12.2*a,b,c* Dispensing device
13*a,b,c*, 13.1*a,c* Cutting contour, cutting arrangement
14*a,b,c* Connection (adhesive, magnetic, form-fitting connection, etc.)
15*b,c* Connection (adhesive, magnetic, form-fitting connection, etc.)
16*a,b,c* Carrier
17*a,c* Adhesive region
17*b* Opening
17.1*b* Introduction area
18*b* Removal strip

19*b* Removal device
$B_{sb}$ Strip width
Db Thickness (initial cutting piece)
$D_{wa,Wb,Wc}$ Diameter (wound reel)
La,b,c Running direction (arrow)
Qa,b,c Run-off point (web)
N1*a,b,c* Nip (winding roll-wound reel)
N2*a,b,c* Nip (winding roll-new core)

What is claimed:

1. A method of transferring a moving web to a new core, the method comprising:

introducing at least one initial cutting piece between the moving web and a winding roll in such a way that a region of the at least one initial cutting piece remains uncovered by the moving web;

connecting the at least one initial cutting piece to the new core after the at least one initial cutting piece reaches a nip formed between the winding roll and the new core, the connecting utilizing at least a temporary connection and occurring in the region of the at least one initial cutting piece which remains uncovered by the moving web; and cutting the moving web to form a new web start at least one of before the nip and before the moving web is wound onto the new core;

wherein the connecting connects a new web start to the new core and thereafter allows the moving web to be wound onto the new core.

2. The method of claim 1, wherein the at least one initial cutting piece is connected to each of the new web start and the new core by one of bonding and adhesive bonding.

3. The method of claim 1, wherein the moving web comprises one of a paper web, a plastic web, a board web and a cardboard web.

4. The method of claim 1, wherein the introducing comprises introducing the at least one initial cutting piece at least in an edge region of the moving web.

5. The method of claim 1, wherein the at least one initial cutting piece comprises, in the region which is not covered by the moving web, a connection arrangement adapted to connect the at least one initial cutting piece to the new core.

6. The method of claim 5, wherein the connection arrangement comprises one of an adhesive connection arrangement, a vulcanization connection arrangement, a touch-and-close connection arrangement, a suction stud connection arrangement, a form-fitting connection arrangement, a frictional-fitting connection arrangement, a welded connection, a magnetic connection arrangement, and an electrostatic connection arrangement.

7. The method of claim 1, wherein the at least one initial cutting piece comprises a region which is covered by the moving web.

8. The method of claim 7, wherein the region which is covered by the moving web comprises at least one adhesive region configured to produce at least a temporary connection between the new web start and the at least one initial cutting piece.

9. The method of claim 7, wherein the region which is covered by the moving web comprises at least one adhesive region configured to produce at least a temporary connection between the moving web and the at least one initial cutting piece.

10. The method of claim 1, wherein the at least one initial cutting piece comprises a thickness which is in the range of between approximately 0.05 mm and approximately 0.5 mm.

11. The method of claim 10, wherein the thickness is in the range of between approximately 0.25 mm and approximately 0.1 mm.

12. The method of claim 1, wherein the at least one initial cutting piece comprises a molded member.

13. The method of claim 1, wherein the at least one initial cutting piece comprises at least one of a plastic material, a metal material, a textile material, a tear-resistant fibrous material, a paper material, and a composite material.

14. The method of claim 1, wherein the at least one initial cutting piece is at least one of releasably connected to a carrier material and detachably connected to a carrier material.

15. The method of claim 1, wherein, before the introducing, the method comprises mounting with a detachable connection the at least one initial cutting piece on at least one carrier.

16. The method of claim 1, further comprising separating at least one carrier from the at least one initial cutting piece.

17. The method of claim 1, wherein, before the introducing, the method comprises feeding the at least one initial cutting piece while being detachably mounted on at least one carrier.

18. The method of claim 17, further comprising separating the at least one carrier from the at least one initial cutting piece before the new web start is fully wound onto the new core.

19. The method of claim 1, wherein the at least one initial cutting piece comprises a cutting arrangement.

20. The method of claim 19, wherein the cutting arrangement comprises at least one of a punching device, a cutting device, a perforating device, and an embossing device.

21. The method of claim 19, wherein the cutting arrangement is configured to at least one of weaken and severe the moving web so as to create the new web start.

22. The method of claim 19, wherein the cutting arrangement is configured to at least one of weaken and severe the moving web so as to create the new web start having at least one edge which is not parallel relative to at least one outer edge of the moving web.

23. The method of claim 1, wherein the introducing comprises introducing the at least one initial cutting piece between the moving web and the winding roll.

24. The method of claim 1, wherein the introducing comprises introducing the at least one initial cutting piece into the nip.

25. The method of claim 1, wherein the introducing comprises introducing with at least one dispensing device the at least one initial cutting piece substantially directly between the moving web and the winding roll.

26. The method of claim 1, wherein the introducing comprises introducing with at least one dispensing device the at least one initial cutting piece into the nip.

27. The method of claim 1, wherein the introducing comprises introducing with at least one dispensing device the at least one initial cutting piece indirectly between the moving web and the winding roll.

28. The method of claim 1, wherein the introducing comprises applying the at least one initial cutting piece to an underside of the moving web and allowing the moving web and the at least one initial cutting piece to pass through the nip.

29. The method of claim 1, wherein the introducing comprises applying the at least one initial cutting piece to a circumferential surface of the winding roll and allowing the moving web and the at least one initial cutting piece to pass through the nip.

30. The method of claim 1, wherein the introducing comprises applying the at least one initial cutting piece to an underside of the new web start and allowing the new web start and the at least one initial cutting piece to pass through the nip.

31. The method of claim 1, wherein the introducing comprises applying the at least one initial cutting piece to a circumferential surface of the winding roll and allowing the new web start and the at least one initial cutting piece to pass through the nip.

32. The method of claim 31, wherein the applying utilizes a temporary connection which is produced by at least one of at least one adhesive area, electrostatic forces, magnetic forces, vacuum, a touch-and-close fastener, and at least one suction stud coupling.

33. The method of claim 1, wherein the cutting comprises enlarging a width of the new web start as it is wound onto the new core.

34. The method of claim 1, wherein the cutting comprises enlarging with a cutting device a width of the new web start as it is wound onto the new core.

35. The method of claim 1, wherein the cutting comprises enlarging with a movable cutting device a width of the new web start as it is wound onto the new core.

36. A winder implementing the method of claim 1, the winder comprising at least one dispensing device configured to introduce the at least one initial cutting piece between the moving web and the winding roll, wherein the at least one dispensing device is arranged to introduce the at least one initial cutting piece substantially directly between the moving web and the winding roll.

37. A winder implementing the method of claim 1, the winder comprising at least one dispensing device configured to introduce the at least one initial cutting piece between the moving web and the winding roll, wherein the at least one dispensing device is arranged to introduce the at least one initial cutting piece indirectly between the moving web and the winding roll.

38. A winder implementing the method of claim 1, the winder comprising at least one dispensing device configured to introduce the at least one initial cutting piece between the moving web and the winding roll, wherein the at least one dispensing device is arranged to apply the at least one initial cutting piece to an underside of the moving web.

39. A winder implementing the method of claim 1, the winder comprising at least one dispensing device configured to introduce the at least one initial cutting piece between the moving web and the winding roll, wherein the at least one dispensing device is arranged to apply the at least one initial cutting piece to a circumference of the winding roll.

40. A winder arrangement comprising:

a winding roll arranged to support a moving web;

a new core forming a nip with the winding roll;

a cutting arrangement arranged upstream of the winding roll in a free running path region of the moving web;

at least one dispensing device configured to introduce at least one initial cutting piece between the moving web and the winding roll; and the cutting arrangement being separated from the at least one initial cutting piece;

wherein the at least one initial cutting piece connects a new web start to the new core and thereafter allows the moving web to be wound onto the new core.

41. The winder of claim 40, wherein the at least one initial cutting piece is configured to substantially completely sever at least a part of the moving web.

42. The winder of claim 40, wherein the at least one initial cutting piece is configured to substantially completely sever with at least one cutting contour at least a part of the moving web.

43. The winder of claim 40, wherein the at least one initial cutting piece comprises at least one adhesive region arranged in the region which is not covered by the moving web.

44. The winder of claim 40, wherein the at least one initial cutting piece comprises at least one adhesive region arranged in a region which is covered by the moving web.

45. The winder of claim 40, wherein the at least one initial cutting piece comprises at least one cutting contour arranged in a region which is covered by the moving web.

46. The winder of claim 45, wherein the at least one cutting contour is oriented at an angle which is not parallel to either a web running direction or transverse to the web running direction.

47. The winder of claim 40, wherein the at least one initial cutting piece comprises a thickness in the range of between approximately 0.05 mm and approximately 0.5 mm.

48. The winder of claim 47, wherein the thickness is in the range of between approximately 0.25 mm and approximately 0.1 mm.

49. The winder of claim 40, wherein the at least one initial cutting piece comprises a molded member.

50. The winder of claim 40, wherein the at least one initial cutting piece comprises at least one of a plastic material, a metal material, a textile material, a tear-resistant fibrous material, a paper material, and a composite material.

51. The winder of claim 40, wherein the at least one initial cutting piece is at least one of releasably connected to a carrier material and detachably connected to a carrier material.

52. The winder of claim 40, wherein the cutting arrangement comprises at least one of a punching device, a cutting device, a perforating device, and an embossing device.

53. The winder of claim 40, wherein the cutting arrangement is configured to at least one of weaken and severe the moving web so as to create the new web start.

54. The winder of claim 40, wherein the cutting arrangement is configured to at least one of weaken and severe the moving web so as to create the new web start having at least one edge which is not parallel relative to at least one outer edge of the moving web.

55. The winder of claim 40, wherein the cutting arrangement comprises at least one cutting device arranged before the nip.

56. The winder of claim 55, wherein the at least one cutting device is arranged on a top side of the moving web.

57. The winder of claim 55, wherein the at least one cutting device is arranged on an underside of the moving web.

58. The winder of claim 55, wherein the at least one cutting device comprises at least one a cutting element.

59. The winder of claim 58, wherein the at least one cutting element comprises one of a high power density jet and a high power density beam.

60. The winder of claim 58, wherein the at least one cutting element comprises one of a water-jet and a laser-beam.

61. The winder of claim 58, wherein the at least one cutting device comprises a single cutting device arranged adjacent an edge of the moving web.

62. The winder of claim 58, wherein the at least one cutting device is configured to move completely transversely across the moving web.

63. The winder of claim 58, wherein the at least one cutting device comprises two cutting devices, each cutting device being arranged adjacent an edge of the moving web.

64. The winder of claim 63, wherein each cutting device is adapted to move to as far as a center of the moving web.

65. The winder of claim 40, wherein the at least one initial cutting piece comprises a device which cuts and transfers the new web start to the new core.

66. A method of transferring a moving web to a new core, the method comprising:

producing at least one opening in a region of the moving web;

introducing, in a region of the at least one opening, at least one initial cutting piece between the moving web and a winding roll in such a way that a region of the at least one initial cutting piece remains uncovered by the moving web;

connecting the at least one initial cutting piece to the new core after the at least one initial cutting piece reaches a nip formed between the winding roll and the new core, the connecting utilizing at least a temporary connection and occurring in the region of the at least one initial cutting piece which remains uncovered by the moving web; and cutting the moving web to form at least two new web starts at least one of before the nip and before the moving web is wound onto the new core;

wherein the connecting connects the at least two new web starts to the new core and thereafter allows the moving web to be wound onto the new core.

67. The method of claim 66, wherein the at least one initial cutting piece is connected to each of the at least two new web starts and the new core by one of bonding and adhesive bonding.

68. The method of claim 66, wherein the moving web comprises one of a paper web, a plastic web, a board web and a cardboard web.

69. The method of claim 66, wherein the introducing comprises introducing the at least one initial cutting piece at least in an edge region of the moving web.

70. The method of claim 66, wherein the at least one initial cutting piece comprises, in a region which is not covered by the moving web, a connection arrangement adapted to connect the at least one initial cutting piece to the new core.

71. The method of claim 70, wherein the connection arrangement comprises one of an adhesive connection arrangement, a vulcanization connection arrangement, a touch-and-close connection arrangement, a suction stud connection arrangement, a form-fitting connection arrangement, a frictional-fitting connection arrangement, a welded connection, a magnetic connection arrangement, and an electrostatic connection arrangement.

72. The method of claim 66, wherein the at least one opening comprises one of a slit and an introduction area.

73. The method of claim 66, wherein the producing comprises producing the at least one opening in a region of the moving web with a first cutting device.

74. The method of claim 73, wherein the producing comprises forming with the first cutting device at least one removal strip.

75. The method of claim 66, wherein the producing comprises producing at least one opening in a center region of the moving web.

76. The method of claim 66, wherein the producing comprises producing at least one opening in a region of the moving web that is between two edge regions of the moving web.

77. The method of claim 66, wherein the producing comprises producing at least one opening in each of two edge regions of the moving web.

78. The method of claim 66, wherein the producing comprises producing the at least one opening in at least one of two edge regions of the moving web.

79. The method of claim 66, further comprising forming with at least one cutting device at least one removal strip having a strip width in the range of between approximately 10 mm and 250 mm.

80. The method of claim 79, wherein the strip width is in the range of between approximately 25 mm and approximately 100 mm.

81. The method of claim 66, further comprising forming with at least one cutting device at least one removal strip and removing the at least one removal strip with at least one removal device.

82. The method of claim 81, wherein the at least one removal device utilizes a vacuum of between approximately 0.01 bar and approximately 0.2 bar.

83. The method of claim 82, wherein the vacuum is between approximately 0.05 bar and approximately 0.1 bar.

84. The method of claim 66, wherein the at least one initial cutting piece comprises, in the region that is not covered by the web, at least one connecting strip non-removably attached to the at least one cutting piece.

85. The method of claim 66, wherein the at least one initial cutting piece comprises a centrally disposed connecting strip non-removably attached to the at least one cutting piece and two angled connecting strips non-removably attached to the at least one cutting piece.

86. The method of claim 85, wherein the connecting strips form a Y-shape.

87. The method of claim 66, wherein the at least one initial cutting piece comprises at least one connecting strip non-removably attached to the at least one cutting piece.

88. The method of claim 66, wherein the at least one connecting strip comprises one of an adhesive connection strip, a vulcanization connection strip, a touch-and-close connection strip, a suction stud connection strip, a form-fitting connection strip, a frictional-fitting connection strip, a welded connection strip, a magnetic connection strip, and an electrostatic connection strip.

89. The method of claim 66, wherein the at least one initial cutting piece comprises a region which is covered by the moving web.

90. The method of claim 89, wherein the region which is covered by the moving web comprises at least one adhesive region configured to produce at least a temporary connection between the at least two new web starts and the at least one initial cutting piece.

91. The method of claim 89, wherein the region which is covered by the moving web comprises at least one adhesive region configured to produce at least a temporary connection between the moving web and the at least one initial cutting piece.

92. The method of claim 66, wherein the at least one initial cutting piece comprises a thickness which is in the range of between approximately 0.05 mm and approximately 0.5 mm.

93. The method of claim 92, wherein the thickness is in the range of between approximately 0.25 mm and approximately 0.1 mm.

94. The method of claim 66, wherein the at least one initial cutting piece comprises a molded member.

95. The method of claim 66, wherein the at least one initial cutting piece comprises at least one of a plastic material, a metal material, a textile material, a tear-resistant fibrous material, a paper material, and a composite material.

96. The method of claim 66, wherein the at least one initial cutting piece is at least one of releasably connected to a carrier material and detachably connected to a carrier material.

97. The method of claim 66, wherein, before the introducing, the method comprises mounting with a detachable connection the at least one initial cutting piece on at least one carrier.

98. The method of claim 97, further comprising separating, before the nip, the at least one carrier from the at least one initial cutting piece.

99. The method of claim 66, wherein the at least one initial cutting piece comprises a cutting arrangement arranged upstream of the winding roll.

100. The method of claim 99, wherein the cutting arrangement comprises at least one of a punching device, a cutting device, a perforating device, and an embossing device.

101. The method of claim 99, wherein the cutting arrangement is configured to at least one of weaken and severe the moving web so as to create the new web start.

102. The method of claim 99, wherein the cutting arrangement is configured to at least one of weaken and severe the moving web so as to create the new web start having at least one edge which is not parallel relative to at least one outer edge of the moving web.

103. The method of claim 66, wherein the cutting utilizes a cutting arrangement arranged upstream of the winding roll.

104. The method of claim 66, further comprising arranging at least one cutting device before the nip.

105. The method of claim 104, wherein the arranging comprises arranging the at least one cutting device on a top side of the moving web.

106. The method of claim 104, wherein the arranging comprises arranging the at least one cutting device on an underside of the moving web.

107. The method of claim 104, wherein the at least one cutting device comprises at least one a cutting element.

108. The method of claim 107, wherein the at least one cutting element comprises one of a high power density jet and a high power density beam.

109. The method of claim 107, wherein the at least one cutting element comprises one of a water-jet and a laser-beam.

110. The method of claim 107, wherein the at least one cutting device comprises a single cutting device arranged adjacent an edge of the moving web.

111. The method of claim 107, wherein the at least one cutting device is configured to move completely transversely across the moving web.

112. The method of claim 107, wherein the at least one cutting device comprises two cutting devices, each cutting device being arranged adjacent an edge of the moving web.

113. The method of claim 112, wherein each cutting device is adapted to move to as far as a center of the moving web.

114. The method of claim 66, wherein the at least one initial cutting piece comprises a device which cuts and transfers the new web start to the new core.

115. The method of claim 66, wherein the introducing comprises introducing the at least one initial cutting piece into the nip.

116. The method of claim 66, wherein the introducing comprises introducing with at least one dispensing device the at least one initial cutting piece substantially directly between the moving web and the winding roll.

117. The method of claim 66, wherein the introducing comprises introducing with at least one dispensing device the at least one initial cutting piece into the nip.

118. The method of claim 66, wherein the introducing comprises introducing with at least one dispensing device the at least one initial cutting piece indirectly between the moving web and the winding roll.

119. The method of claim 66, wherein the introducing comprises applying the at least one initial cutting piece to an underside of the moving web and allowing the moving web and the at least one initial cutting piece to pass through the nip.

120. The method of claim 66, wherein the introducing comprises applying the at least one initial cutting piece to a circumferential surface of the winding roll and allowing the moving web and the at least one initial cutting piece to pass through the nip.

121. The method of claim 66, wherein the introducing comprises applying the at least one initial cutting piece to an underside of the at least two new web starts and allowing the at least two new web starts and the at least one initial cutting piece to pass through the nip.

122. The method of claim 66, wherein the introducing comprises applying the at least one initial cutting piece to a circumferential surface of the winding roll and allowing the at least two new web starts and the at least one initial cutting piece to pass through the nip.

123. The method of claim 122, wherein the applying utilizes a temporary connection which is produced by at least one of at least one adhesive area, electrostatic forces, magnetic forces, vacuum, a touch-and-close fastener, and at least one suction stud coupling.

124. The method of claim 66, wherein the at least one initial cutting piece is configured to at least one of cut and transfer the moving web to the new core.

125. The method of claim 66, wherein the at least one initial cutting piece is configured to at least one of cut and transfer the at least two new web starts to the new core.

126. The method of claim 66, wherein the cutting comprises enlarging a width of each new web start as it is wound onto the new core.

127. The method of claim 66, wherein the cutting comprises enlarging with a cutting device a width of each new web start as it is wound onto the new core.

128. The method of claim 66, wherein the cutting comprises enlarging with a movable cutting device a width of each new web start as it is wound onto the new core.

129. The method of claim 66, wherein the cutting utilizes first and second movable cutting devices.

130. The method of claim 66, wherein the cutting utilizes first and second cutting devices which move in a plane that is at least approximately parallel to the moving web.

131. The method of claim 66, wherein the cutting comprises forming with at least one cutting device at least one oblique cutting line in the moving web.

132. The method of claim 66, wherein the cutting comprises, before the nip, severing completely at least a portion of the moving web with at least one cutting device.

133. A winder arrangement comprising:

a winding roll arranged to support a moving web;

a new core forming a nip with the winding roll;

at least one cutting device producing at least one opening in the moving web; and at least one dispensing device configured to introduce at least one initial cutting piece between the moving web and the winding roll;

wherein the at least one initial cutting piece connects at least one new web start to the new core and thereafter allows the moving web to be wound onto the new core.

134. The winder of claim 133, wherein the at least one initial cutting piece is configured to substantially completely sever at least a part of the moving web.

135. The winder of claim 133, wherein the at least one initial cutting piece is configured to substantially completely sever with at least one cutting contour at least a part of the moving web.

136. The winder of claim 133, wherein the at least one initial cutting piece comprises at least one adhesive region arranged in the region which is not covered by the moving web.

137. The winder of claim 133, wherein the at least one initial cutting piece comprises at least one adhesive region arranged in a region which is covered by the moving web.

138. The winder of claim 133, wherein the at least one initial cutting piece comprises at least one cutting contour arranged in a region which is covered by the moving web.

139. The winder of claim 138, wherein the at least one cutting contour is oriented at an angle which is not parallel to either a web running direction or transverse to the web running direction.

140. The winder of claim 133, wherein the at least one initial cutting piece comprises a thickness in the range of between approximately 0.05 mm and approximately 0.5 mm.

141. The winder of claim 140, wherein the thickness is in the range of between approximately 0.25 mm and approximately 0.1 mm.

142. The winder of claim 133, wherein the at least one initial cutting piece comprises a molded member.

143. The winder of claim 133, wherein the at least one initial cutting piece comprises at least one of a plastic material, a metal material, a textile material, a tear-resistant fibrous material, a paper material, and a composite material.

144. The winder of claim 133, wherein the at least one initial cutting piece is at least one of releasably connected to a carrier material and detachably connected to a carrier material.

145. The winder of claim 133, wherein the at least one initial cutting piece comprises a cutting arrangement arranged upstream of the winding roll in a free running path region of the moving web.

146. The winder of claim 145, wherein the cutting arrangement comprises at least one of a punching device, a cutting device, a perforating device, and an embossing device.

147. The winder of claim 145, wherein the cutting arrangement is configured to at least one of weaken and severe the moving web so as to create the new web start.

148. The winder of claim 145, wherein the cutting arrangement is configured to at least one of weaken and severe the moving web so as to create the new web start having at least one edge which is not parallel relative to at least one outer edge of the moving web.

149. The winder of claim 133, wherein the at least one initial cutting piece comprises a cutting arrangement arranged upstream of the winding roll in a region of another roll.

150. The winder of claim 133, wherein the at least one cutting device is arranged before the nip.

151. The winder of claim 150, wherein the at least one cutting device is arranged on a top side of the moving web.

152. The winder of claim 150, wherein the at least one cutting device is arranged on an underside of the moving web.

153. The winder of claim 150, wherein the at least one cutting device comprises two cutting devices each having at least one a cutting element.

154. The winder of claim 153, wherein each at least one cutting element comprises one of a high power density jet and a high power density beam.

155. The winder of claim 153, wherein each at least one cutting element comprises one of a water-jet and a laser-beam.

156. The winder of claim 133, wherein the at least one cutting device comprises two cutting devices arranged on a common device.

157. The winder of claim 133, wherein the at least one cutting device comprises two cutting devices, each configured to move transversely across the moving web.

158. The winder of claim 157, wherein each cutting device is adapted to move to as far as a center of the moving web.

159. A method of transferring a moving web to a new core, the method comprising:

producing with at least one cutting device at least one transfer strip in an edge region of the moving web;

introducing with at least one dispensing device at least one initial cutting piece between the at least one transfer strip and a winding roll in such a way that a region of the at least one initial cutting piece remains uncovered by the at least one transfer strip;

connecting the at least one initial cutting piece to the new core, the connecting utilizing at least a temporary connection and occurring in the region of the at least one initial cutting piece which remains uncovered by the moving web; and cutting the at least one transfer strip with the at least one initial cutting piece;

wherein the connecting connects at least one new web start to the new core and thereafter allows the moving web to be wound onto the new core.

160. The method of claim 159, wherein the connecting comprises connecting the at least one initial cutting piece to the new core after the at least one initial cutting piece reaches a nip formed between the winding roll and the new core.

161. The method of claim 159, wherein the at least one initial cutting piece is connected to the at one new web start and the new core by one of bonding and adhesive bonding.

162. The method of claim 159, wherein the moving web comprises one of a paper web, a plastic web, a board web and a cardboard web.

163. The method of claim 159, wherein the introducing comprises introducing the at least one initial cutting piece in each of two edge regions of the moving web.

164. The method of claim 159, wherein the at least one initial cutting piece comprises, in a region which is not covered by the at least one transfer strip, a connection arrangement adapted to connect the at least one initial cutting piece to the new core.

165. The method of claim 164, wherein the connection arrangement comprises one of an adhesive connection arrangement, a vulcanization connection arrangement, a touch-and-close connection arrangement, a suction stud connection arrangement, a form-fitting connection arrangement, a frictional-fitting connection arrangement, a welded connection, a magnetic connection arrangement, and an electrostatic connection arrangement.

166. The method of claim 159, wherein the at least one initial cutting piece comprises, in the region that is not covered by the web, at least one connecting strip non-removably attached to the at least one cutting piece.

167. The method of claim 159, wherein the at least one initial cutting piece comprises at least one connecting strip non-removably attached to the at least one cutting piece.

168. The method of claim 167, wherein the at least one connecting strip comprises one of an adhesive connection strip, a vulcanization connection strip, a touch-and-close connection strip, a suction stud connection strip, a form-fitting connection strip, a frictional-fitting connection strip, a welded connection strip, a magnetic connection strip, and an electrostatic connection strip.

169. The method of claim 159, wherein the at least one initial cutting piece comprises a region which is covered by the at least one transfer strip.

170. The method of claim 169, wherein the region which is covered by the at least one transfer strip comprises at least one adhesive region configured to produce at least a temporary connection between the at least one new web start and the at least one initial cutting piece.

171. The method of claim 169, wherein the region which is covered by the at least one transfer strip comprises at least one adhesive region configured to produce at least a temporary connection between the at least one transfer strip and the at least one initial cutting piece.

172. The method of claim 159, wherein the at least one initial cutting piece comprises a thickness which is in the range of between approximately 0.05 mm and approximately 0.5 mm.

173. The method of claim 122, wherein the thickness is in the range of between approximately 0.25 mm and approximately 0.1 mm.

174. The method of claim 159, wherein the at least one initial cutting piece comprises a molded member that comprises at least one of a plastic material, a metal material, a textile material, a tear-resistant fibrous material, a paper material, and a composite material.

175. The method of claim 159, wherein the at least one initial cutting piece is at least one of releasably connected to a carrier material and detachably connected to a carrier material.

176. The method of claim 159, wherein, before the introducing, the method comprises mounting with a detachable connection the at least one initial cutting piece on at least one carrier.

177. The method of claim 176, further comprising separating, before the nip, the at least one carrier from the at least one initial cutting piece.

178. The method of claim 159, wherein the at least one initial cutting piece comprises a cutting arrangement.

179. The method of claim 178, wherein the cutting arrangement comprises at least one of a punching device, a cutting device, a perforating device, and an embossing device.

180. The method of claim 178, wherein the cutting arrangement is configured to at least one of weaken and severe the moving web so as to create the new web start.

181. The method of claim 178, wherein the cutting arrangement is configured to at least one of weaken and severe the moving web so as to create the new web start having at least one edge which is not parallel relative to at least one outer edge of the moving web.

182. The method of claim 159, further comprising arranging the at least one cutting device before the nip.

183. The method of claim 182, wherein the arranging comprises arranging the at least one cutting device on a top side of the moving web.

184. The method of claim 182, wherein the arranging comprises arranging the at least one cutting device on an underside of the moving web.

185. The method of claim 159, wherein the introducing comprises introducing the at least one initial cutting piece substantially directly between the at least one transfer strip and the winding roll.

186. The method of claim 159, wherein the introducing comprises introducing the at least one initial cutting piece into the nip.

187. The method of claim 159, wherein the introducing comprises introducing the at least one initial cutting piece indirectly between the at least one transfer strip and the winding roll.

188. The method of claim 159, wherein the introducing comprises applying the at least one initial cutting piece to an underside of the at least one transfer strip and allowing the at least one transfer strip and the at least one initial cutting piece to pass through the nip.

189. The method of claim 159, wherein the introducing comprises applying the at least one initial cutting piece to a circumferential surface of the winding roll and allowing the at least one transfer strip and the at least one initial cutting piece to pass through the nip.

190. The method of claim 159, wherein the introducing comprises applying the at least one initial cutting piece to an underside of the at least one new web start and allowing the at least one new web start and the at least one initial cutting piece to pass through the nip.

191. The method of claim 190, wherein the applying utilizes a temporary connection which is produced by at least one of at least one adhesive area, electrostatic forces, magnetic forces, vacuum, a touch-and-close fastener, and at least one suction stud coupling.

192. The method of claim 159, wherein the at least one initial cutting piece is configured to sever substantially completely the at least one transfer strip.

193. The method of claim 159, wherein the at least one initial cutting piece comprises a cutting contour configured to sever substantially completely the at least one transfer strip along the cutting contour.

194. The method of claim 159, wherein the cutting comprises enlarging a width of the at least one new web start as it is wound onto the new core.

* * * * *